US012551019B2

(12) United States Patent
Chen

(10) Patent No.: US 12,551,019 B2
(45) Date of Patent: Feb. 17, 2026

(54) CHAIR SEAT

(71) Applicant: ATEC INTERNATIONAL TEAM CO., LTD., Taoyuan (TW)

(72) Inventor: Te-Chun Chen, Taoyuan (TW)

(73) Assignee: ATEC INTERNATIONAL TEAM CO., LTD., Taoyuan (TW)

( * ) Notice: Subject to any disclaimer, the term of this patent is extended or adjusted under 35 U.S.C. 154(b) by 194 days.

(21) Appl. No.: 18/399,687

(22) Filed: Dec. 29, 2023

(65) Prior Publication Data

US 2024/0341485 A1 Oct. 17, 2024

Related U.S. Application Data

(63) Continuation-in-part of application No. 18/211,724, filed on Jun. 20, 2023.

(30) Foreign Application Priority Data

Apr. 13, 2023 (CN) ..... 202310390436.5

(51) Int. Cl.
*A47C 7/54* (2006.01)

(52) U.S. Cl.
CPC ..... *A47C 7/541* (2018.08); *A47C 7/546* (2013.01)

(58) Field of Classification Search
CPC ..... A47C 7/546
See application file for complete search history.

(56) References Cited

U.S. PATENT DOCUMENTS 4,536,031 A * 8/1985 Latone ..... A47C 7/40 297/383
5,338,133 A * 8/1994 Tornero ..... A47C 1/03 297/411.37 X (Continued)

FOREIGN PATENT DOCUMENTS

TW 543418 U 12/2002
TW M552305 U 12/2017

OTHER PUBLICATIONS

PCT Search report issued on Jun. 3, 2024.

*Primary Examiner* — Rodney B White
(74) *Attorney, Agent, or Firm* — LANWAY IPR SERVICES; Chun-Ming Shih

(57) ABSTRACT

A chair seat combined with two armrests, each comprising crossbar with first toothed structure, is provided. Chair seat includes base and clamping devices. Base comprises armrest slot and mounting holes, where armrest slot accommodates crossbar and mounting holes are connected to armrest slot. Additionally, each of two clamping devices, installed in the two mounting holes, includes mounting base, clamping element, operating component, and transmission element. Mounting base is installed and fixed in mounting hole, with one side of mounting base having installation groove. Clamping element is installed in installation groove and has second toothed structure facing first toothed structure. Operating component is positioned on other side of mounting base relative to installation groove. Transmission element connects clamping element and operating component. Operating component is adapted to drive transmission element, causing clamping element to move towards and clamp crossbar, thus enabling second toothed structure to engage closely with first toothed structure.

12 Claims, 26 Drawing Sheets

(56) References Cited

U.S. PATENT DOCUMENTS 5,368,364 A * 11/1994 Kanai ..... A47C 7/546
297/411.27
5,419,617 A * 5/1995 Schultz ..... A47C 7/546
297/411.27 X
5,462,338 A * 10/1995 Baumann ..... A47C 1/03
297/411.37 X
5,615,926 A * 4/1997 Kanai ..... A47C 7/546
297/411.27
5,839,784 A * 11/1998 Breen ..... A47C 1/0307
297/411.37 X
5,944,387 A * 8/1999 Stumpf ..... A47C 1/03
297/411.37
6,409,266 B1 * 6/2002 Chen ..... A47C 1/03
297/411.37 X
6,572,195 B1 * 6/2003 Lee ..... A47C 1/0307
297/411.37
7,806,481 B2 * 10/2010 Eberlein ..... A47C 1/03
297/411.37
8,104,838 B2 * 1/2012 Tsai ..... A47C 1/0307
297/411.37 X
8,449,035 B2 * 5/2013 Breitkreuz ..... A47C 7/42
297/411.37 X
8,459,746 B2 * 6/2013 Lai ..... A47C 1/0307
297/411.27
9,578,971 B2 * 2/2017 Su ..... A47C 1/03
9,795,220 B1 * 10/2017 Chen ..... A47C 1/03
10,772,434 B2 * 9/2020 Susie ..... A47C 7/546
11,478,085 B2 * 10/2022 Sollie ..... A47C 7/541
11,622,631 B1 * 4/2023 Berkowitz ..... A47C 7/004
297/452.41
11,672,347 B1 * 6/2023 Wu ..... A47C 7/42
297/440.15
11,898,584 B2 * 2/2024 Slach ..... F16B 12/2009
11,950,709 B2 * 4/2024 Bock ..... A47C 4/028
2010/0123346 A1 * 5/2010 Lin ..... A47C 1/03
297/411.37

* cited by examiner

CHAIR SEAT

FIELD OF THE DISCLOSURE

The invention relates to a chair seat, particularly to a chair seat featuring a first toothed structure and clamping elements.

BACKGROUND OF THE INVENTION

In today's increasingly demanding work and living environments, the requirements for office chairs are becoming more sophisticated. Apart from flexibility, comfort, and aesthetic appeal, there is a growing need for chairs with adjustable features to accommodate users of different heights, body types, and usage preferences. The design of office chairs with adjustable armrests aims to meet these needs. However, this design approach has its drawbacks. Firstly, assembly can be challenging, especially for users without specific technical skills. Secondly, such designs often require more components, increasing both the complexity of assembly and the cost of production. Finally, due to the assembly challenges, these chairs are not suitable for the DIY furniture market. Thus, resolving these issues to create adjustable armrest office chairs that are efficient, low-cost, and easy to assemble is a problem worth considering for those skilled in the art.

SUMMARY OF THE INVENTION

The objective of this invention is to provide a chair seat that offers the advantages of high efficiency, low cost, ease of assembly, and convenience in adjusting the positions of the left and right armrests.

The chair seat of the present invention is designed to be combined with two armrests, each comprising a crossbar with a first toothed structure. The chair seat includes a base and two clamping devices. The base comprises at least one armrest slot and two mounting holes, where the armrest slot is suitable for the insertion of the crossbar, and the mounting holes are connected to the armrest slot. Furthermore, each of the two clamping devices, installed in the two mounting holes, includes a mounting base, a clamping element, an operating component, and a transmission element. The mounting base is installed and fixed in the mounting hole, with one side of the mounting base having an installation groove. The clamping element, installed in the installation groove, has a second toothed structure facing the first toothed structure. The operating component is positioned on the other side of the mounting base relative to the installation groove. The transmission element connects the clamping element and the operating component. The operating component is adapted to drive the transmission element, causing the clamping element to move towards and clamp the crossbar, thus enabling the second toothed structure to engage closely with the first toothed structure.

In another embodiment of the invention, a chair seat is designed to be combined with two armrests, each comprising a crossbar with a crossbar slot. The chair seat includes two first toothed structures, a base, and two clamping devices. The first toothed structures are embedded in the crossbar slot. The base comprises at least one armrest slot and two mounting holes, with the armrest slot suitable for the insertion of the crossbar, and the mounting holes connected to the armrest slot. Each of the two clamping devices includes a mounting base, a clamping element, an operating component, and a transmission element. The mounting base is installed and fixed in the mounting hole, with one side having an installation groove. The clamping element, installed in the installation groove, has a second toothed structure facing the first toothed structure. The operating component is positioned on the other side of the mounting base relative to the installation groove. The transmission element connects the clamping element and the operating component. The operating component is adapted to drive the transmission element, causing the clamping element to move towards and clamp the crossbar, thus enabling the second toothed structure to engage closely with the first toothed structure.

In the chair seat described above, the first toothed structure comprises multiple closely arranged first limit bars. The second toothed structure includes multiple closely arranged second limit bars, with each second limit bar being parallel to each first limit bar. In the chair seat, the operating component is a rotating handle with a central hole, and the transmission element includes an installation shaft and a pressing piece. The installation shaft is installed at one end in the central hole, and the pressing piece is installed at the other end of the installation shaft and located within the installation groove. The pressing piece, near the installation groove, has a first ratchet piece, and presses against the clamping element. A second ratchet piece is located at the bottom of the installation groove and engaged with the first ratchet piece. When the rotating handle is turned in one direction, the installation shaft moves the first and second ratchet pieces relative to each other, causing the pressing piece to move the clamping element towards and clamp the crossbar.

In the chair seat, the pressing piece also includes two first limit pieces, each located on either side of the first ratchet piece, in parallel symmetry. The installation groove also includes two second limit pieces, each located on either side of the second ratchet piece, in parallel symmetry. The chair seat also includes two anti-slip plates, each mounting hole of the base having a neighboring embedding hole for the anti-slip plate. The anti-slip plate is installed in the embedding hole, and the mounting base has a first engaging edge and a second engaging edge on its opposing sides. The mounting base is supported on the base by the first and second engaging edges, with the first engaging edge abutting against the anti-slip plate. The embedding hole and mounting hole are separated by a support beam, with the first engaging edge being supported on the support beam. The width of the first engaging edge is greater than the width of the support beam, and the width of the second engaging edge engaging with the base is less than the width of the anti-slip plate. The anti-slip plate has an anti-pull structure, which engages with the support beam.

This invention has the following advantages: It allows users to easily and quickly assemble the armrests on either side of the chair pad, and also reduces the packaging size, significantly lowering the cost of transporting the chair seat product.

The foregoing, as well as additional objects, features and advantages of the invention will be more readily apparent from the following detailed description, which proceeds with reference to the accompanying drawings.

BRIEF DESCRIPTION OF THE DRAWINGS

The objects, spirits, and advantages of the preferred embodiments of the present disclosure will be readily understood by the accompanying drawings and detailed descriptions, wherein.

DESCRIPTION OF THE PREFERRED EMBODIMENTS

Figure 1A:
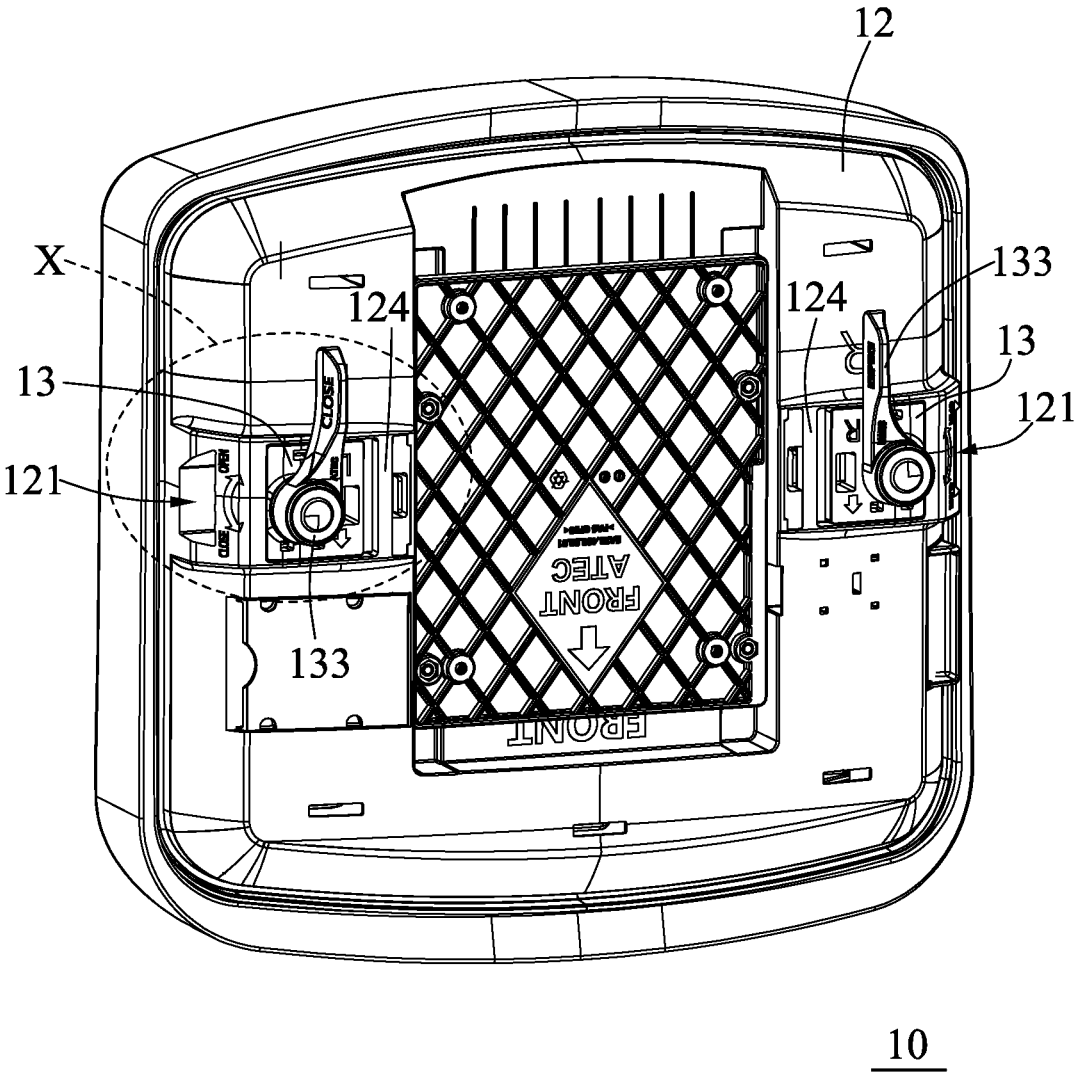
FIG. 1A illustrates a schematic view of the chair seat 10 in this embodiment.
Figure 1B:
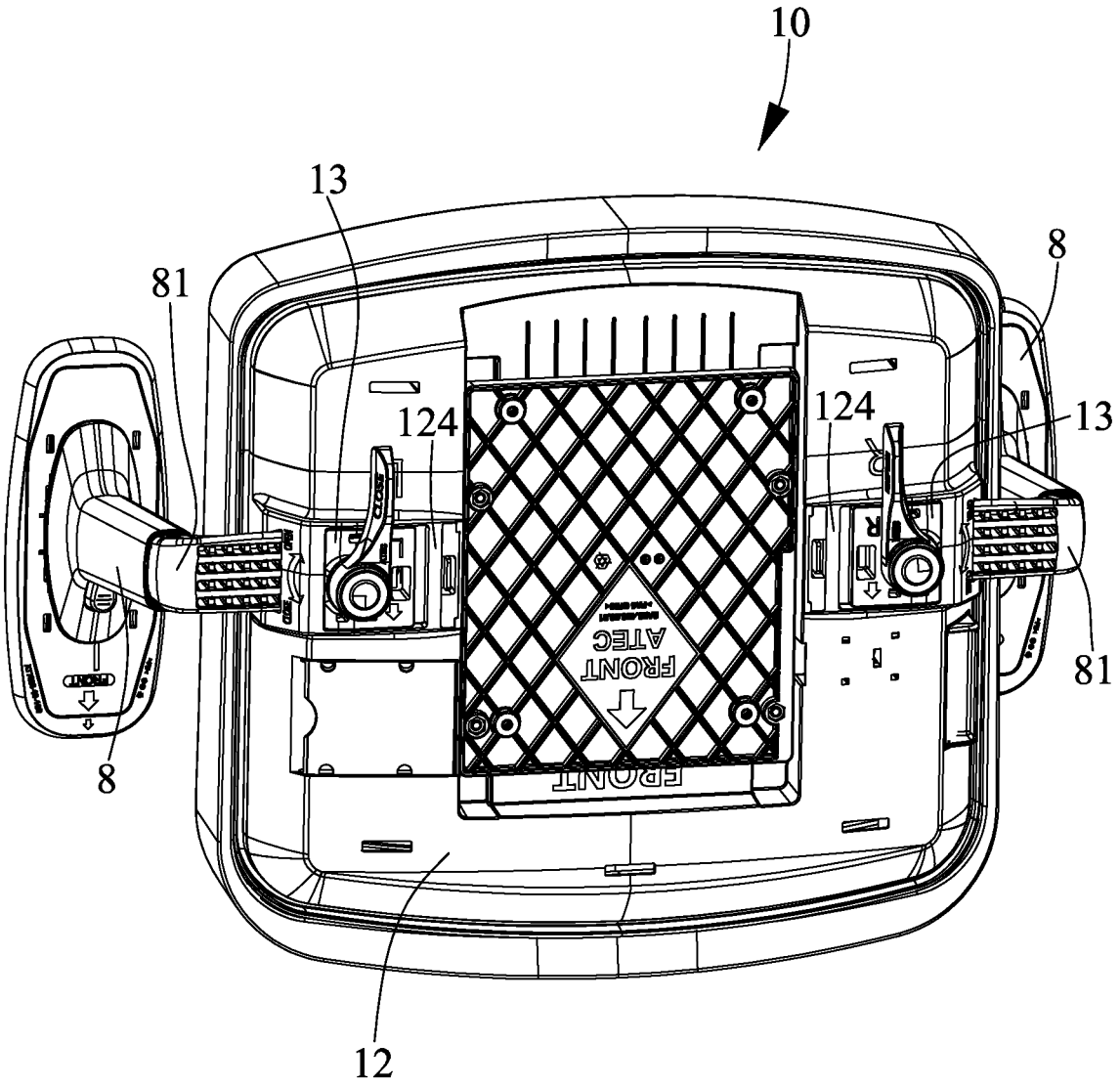
FIG. 1B illustrates a schematic view of the chair seat 10 combined with two armrests 8.
Figure 1C:
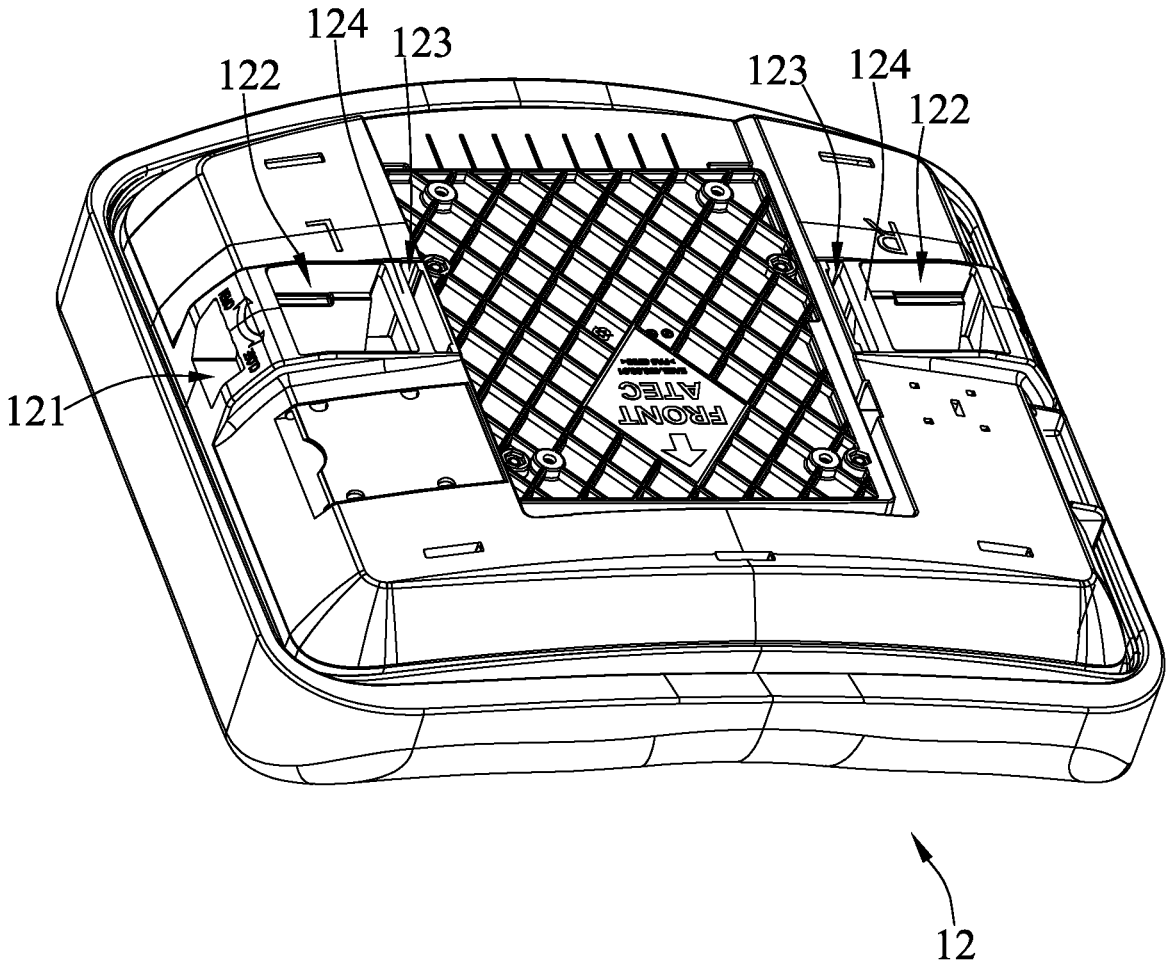
FIG. 1C illustrates a schematic view of the mounting hole 122.

Refer to FIGS. 1A to 1C, where FIG. 1A illustrates a schematic view of the chair seat 10 of this embodiment, FIG. 1B illustrates a schematic view of the chair seat 10 combined with two armrests 8, and FIG. 1C illustrates a schematic view of the mounting hole 122 of the base 12.

The chair seat 10 of this embodiment includes a base 12 and two clamping devices 13. The base 12 comprises two armrest slots 121, two mounting holes 122, two embedding holes 123, and two support beams 124. Each mounting hole 122 is in communication with one of the armrest slots 121 and is adjacent to an embedding hole 123. Each mounting hole 122 is separated from its adjacent embedding hole 123 by a support beam 124.

Figure 2:
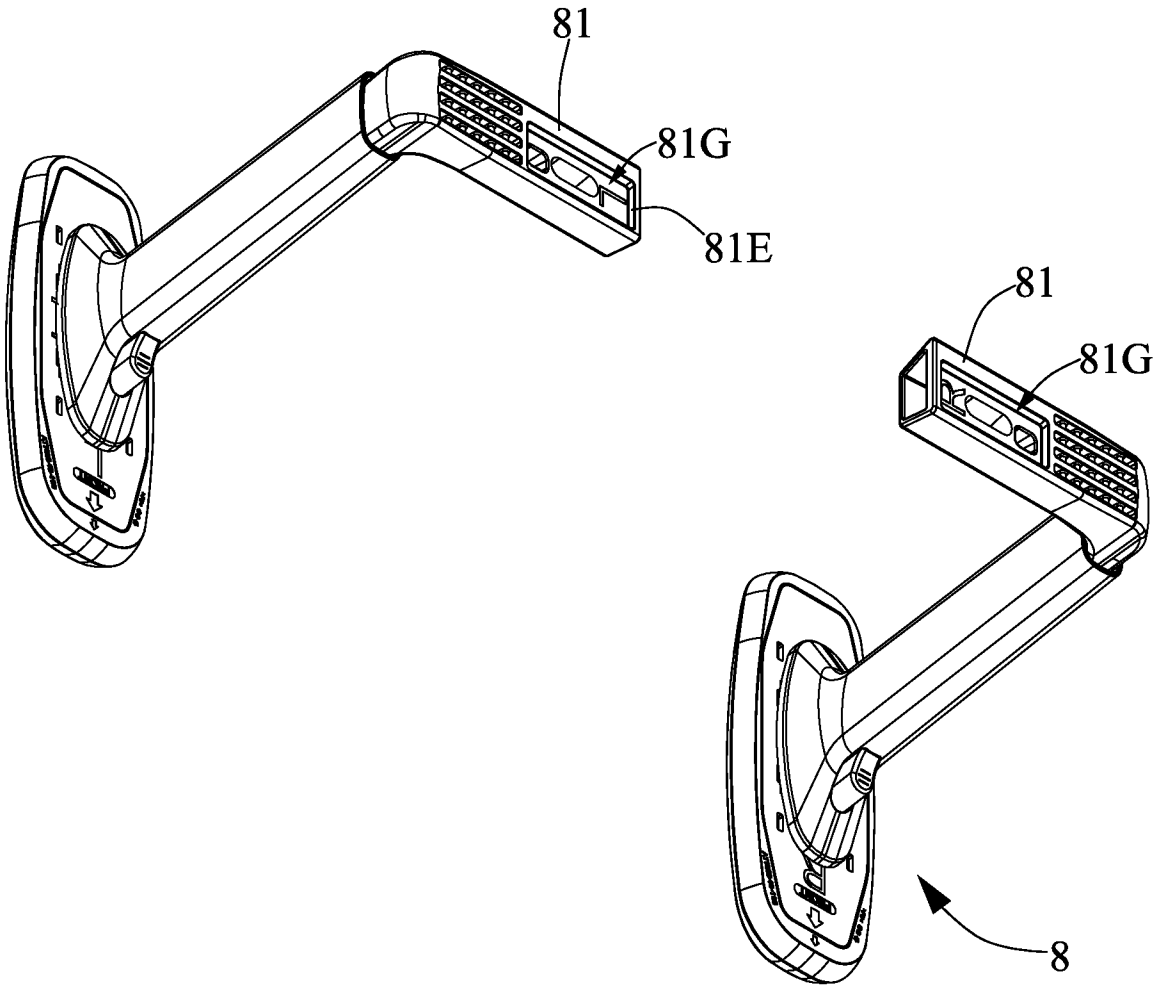
FIG. 2 illustrates a schematic view of the armrest 8.

Refer to FIGS. 1C and 2, where FIG. 2 illustrates a schematic view of two armrests 8. The chair seat 10 is designed to be combined with two armrests 8, each including a crossbar 81, which is equipped with a crossbar slot 81G. Specifically, one end of the crossbar 81 of armrest 8 is inserted into the armrest slot 121 of the base 12. The lateral length of the crossbar slot 81G defines the range of movement for armrest 8, and the position of armrest 8 is fixed by the clamping device 13, which will be further explained in the following paragraphs.

Figure 3A:
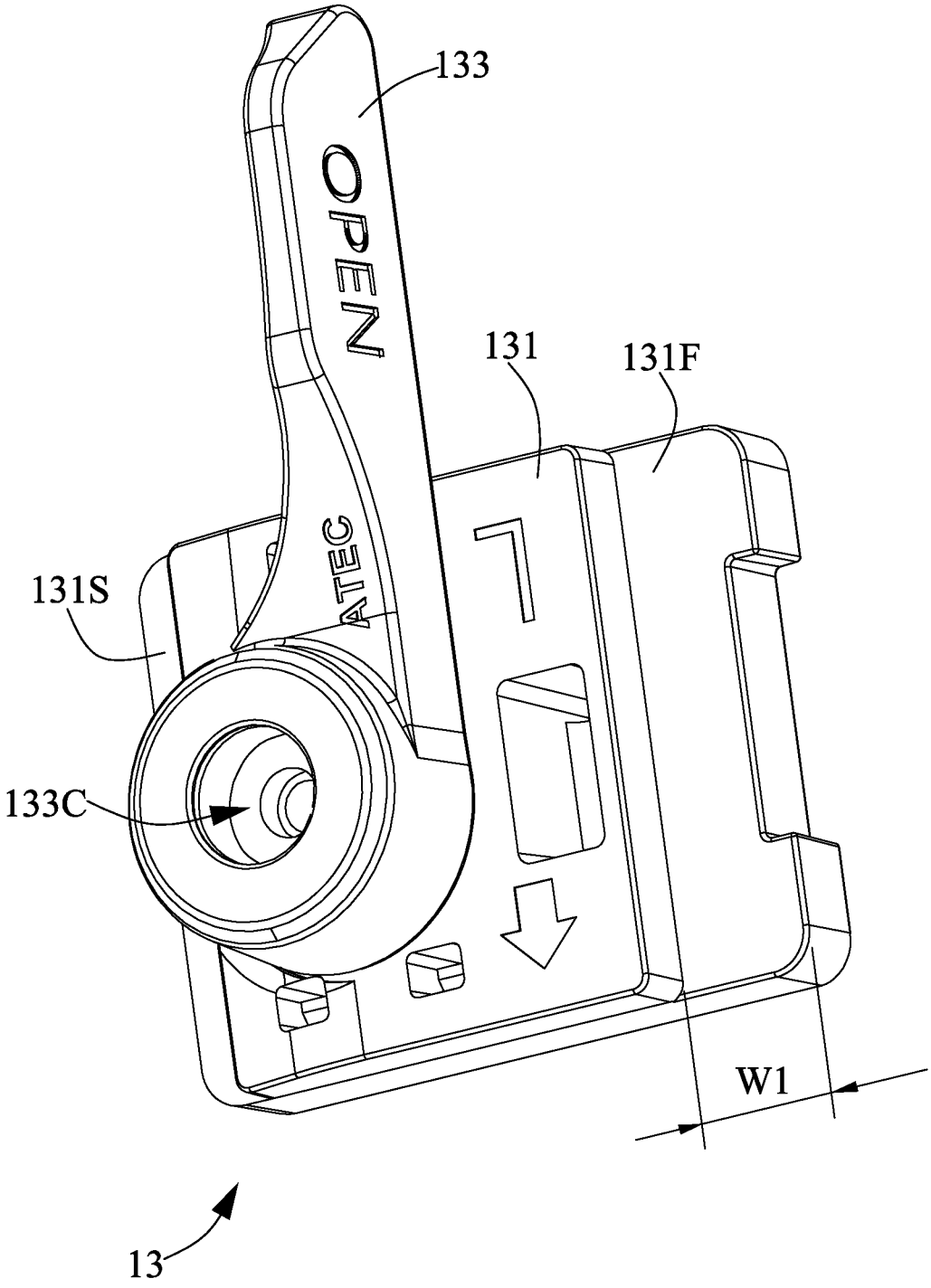
FIGS. 3A and 3B illustrate schematic views of the clamping device 13.
Figure 3B:
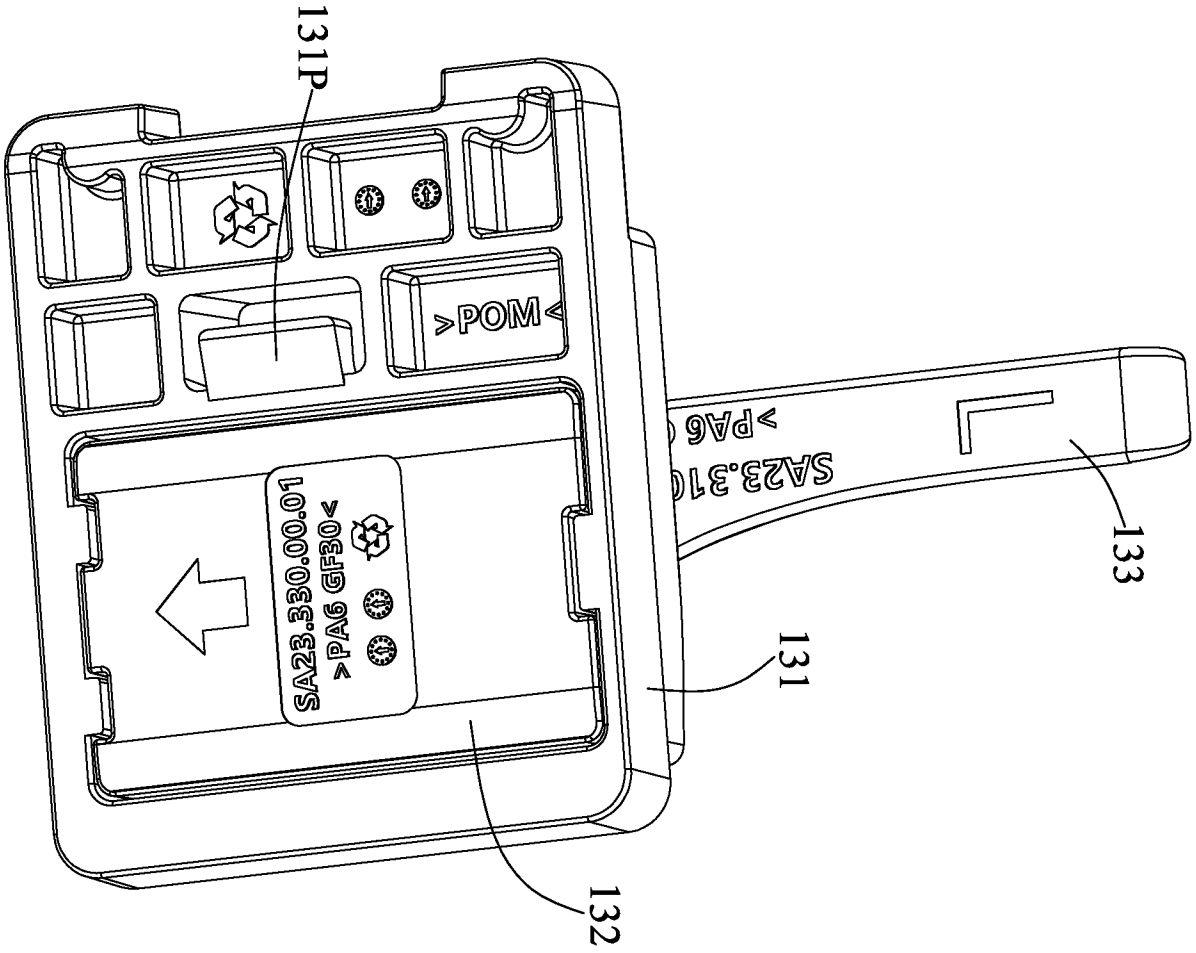
Figure 3C:
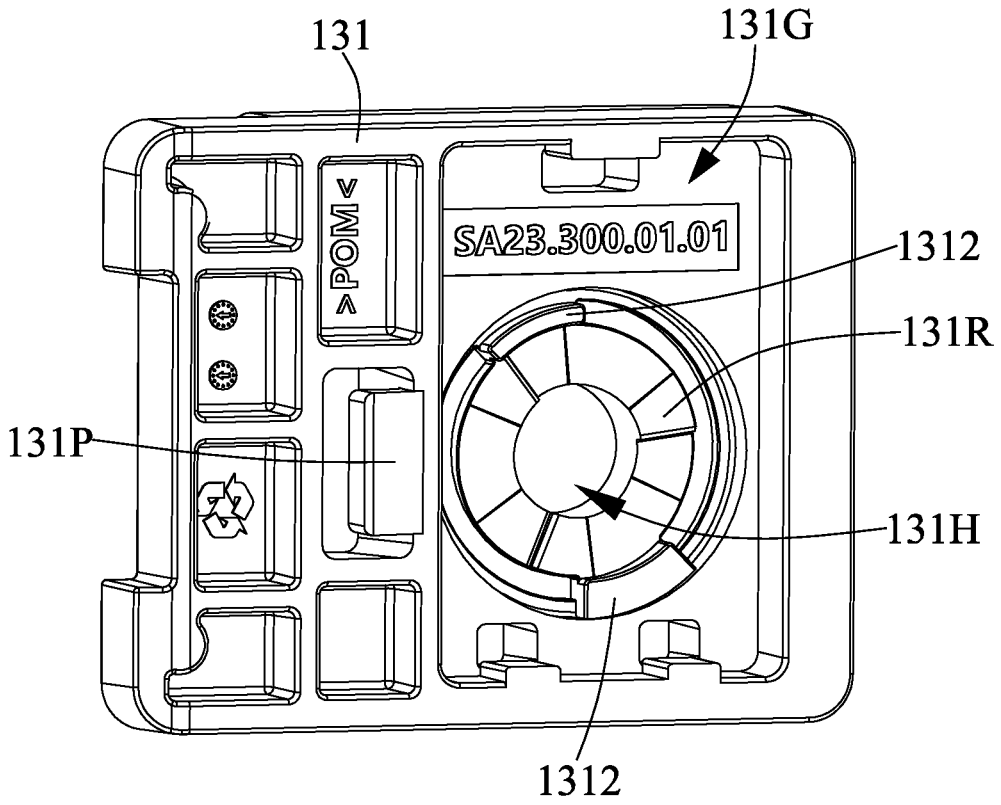
FIG. 3C illustrates a schematic view of the installation groove 131G.
Figure 3D:
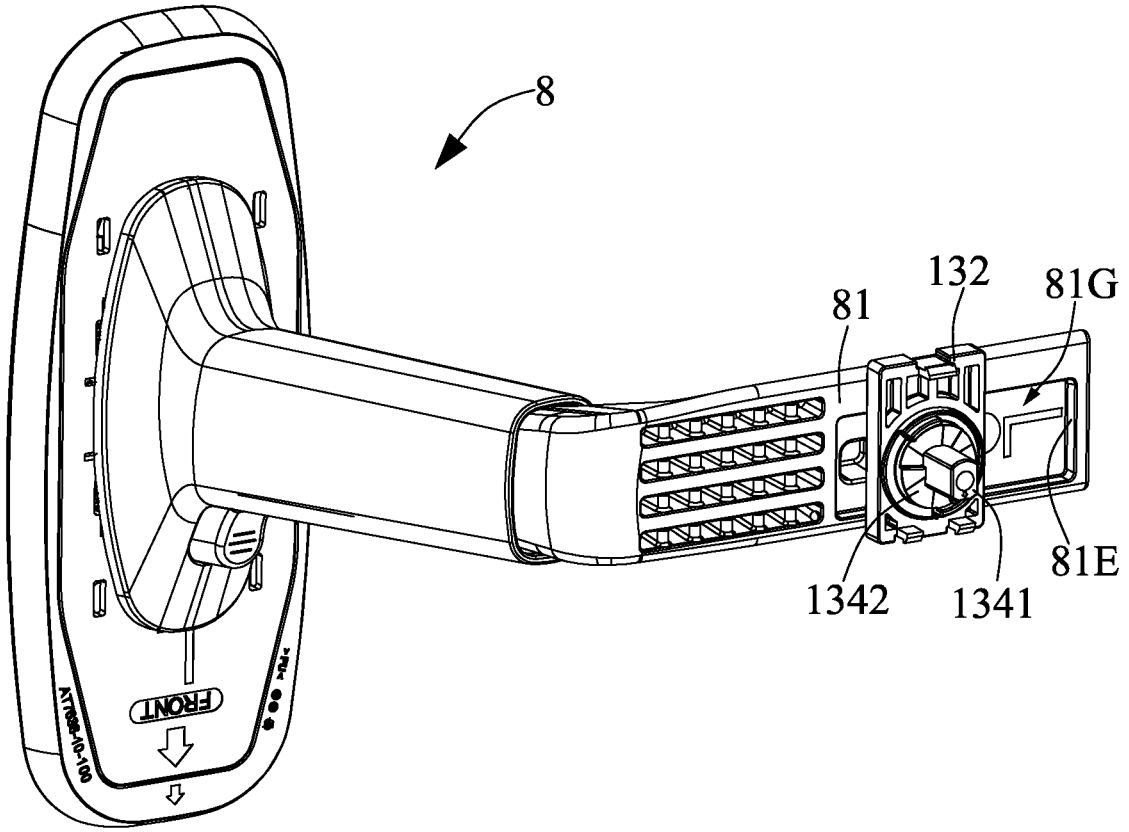
FIG. 3D illustrates a schematic view of the clamping element 132 facing the crossbar 81.

Refer to FIGS. 3A to 3D, where FIGS. 3A and 3B illustrate schematic views of the clamping device 13, FIG. 3C illustrates a schematic view of the installation groove 131G, and FIG. 3D illustrates a schematic view of the clamping element 132 facing the crossbar 81. The two clamping devices 13 are installed in the two mounting holes 122. Each clamping device 13 includes a mounting base 131, a clamping element 132, an operating component 133, and a transmission element 134 (refer to FIG. 5). The mounting base 131 is installed and fixed within the mounting hole 122, and one side of the mounting base 131 is equipped with an installation groove 131G and an anti-pull piece 131P. The anti-pull piece 131P is designed to engage with one edge 81E of the crossbar slot 81G of the crossbar 81. This prevents the crossbar 81 from being pulled out or dropped from the armrest slot 121.

Figure 3E:
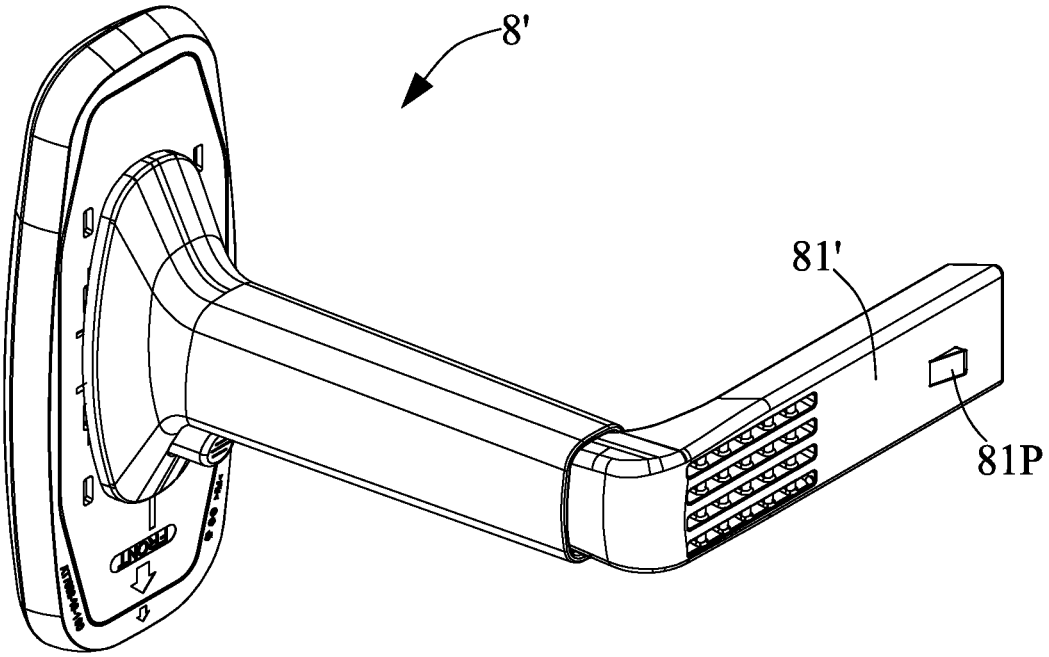
FIG. 3E illustrates a schematic view of the armrest 8'.
Figure 3F:
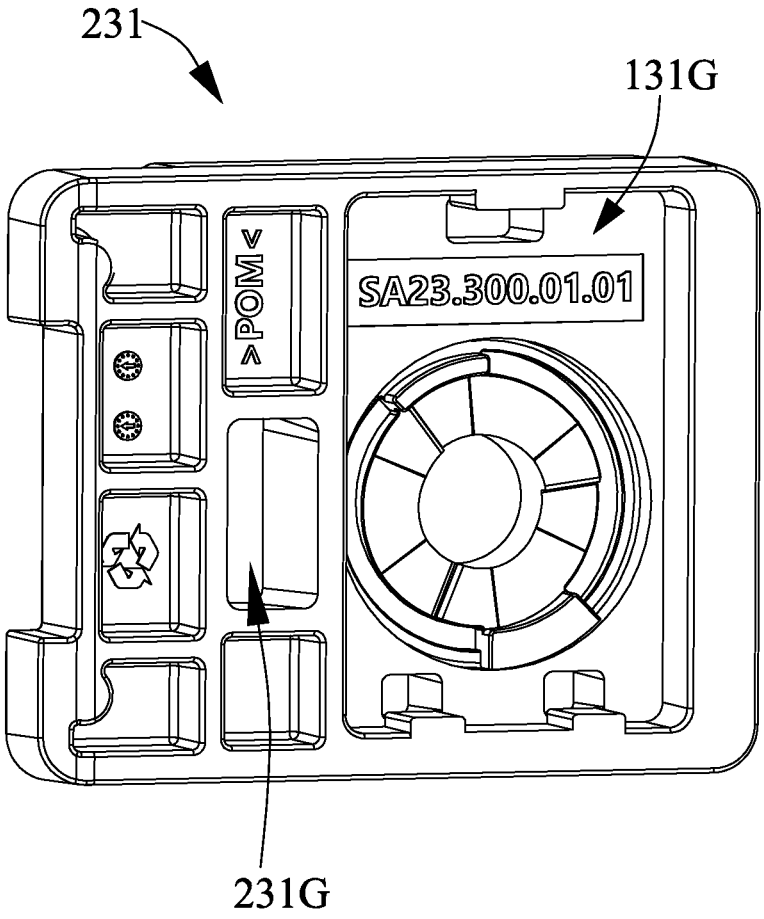
FIG. 3F illustrates a schematic view of the mounting base 231.

In this embodiment, the mounting base 131 is equipped with the anti-pull piece 131P, and the crossbar 81 is equipped with the crossbar slot 81G. However, in other embodiments, the positions of the anti-pull piece 131P and the crossbar slot 81G can be interchanged. Specifically, refer to FIGS. 3E and 3F, where the armrest 8' has an anti-pull piece 81P on the crossbar 81', and the mounting base 231 is equipped with a slot 231G, with both the slot 231G and the installation groove 131G located on the same side of the mounting base 231. The anti-pull piece 81P of the crossbar 81' engages with one edge of the slot 231G. This similarly prevents the crossbar 81' of armrest 8' from being pulled out or dropped from the armrest slot 121.

Furthermore, the operating component 133 is positioned on the other side of the mounting base 131 relative to the installation groove 131G, i.e., exposed outside the base 12, for convenient operation by consumers. For example, the operating component 133 could be a rotating handle with a central hole 133C. Additionally, the clamping element 132 is installed in the installation groove 131G and faces the crossbar 81.

In this embodiment, the operating component 133 is a rotating handle. However, in other embodiments, the operating component 133 could also be a knob, allowing for finer adjustment and control, and easier precision operation.

Figure 4A:
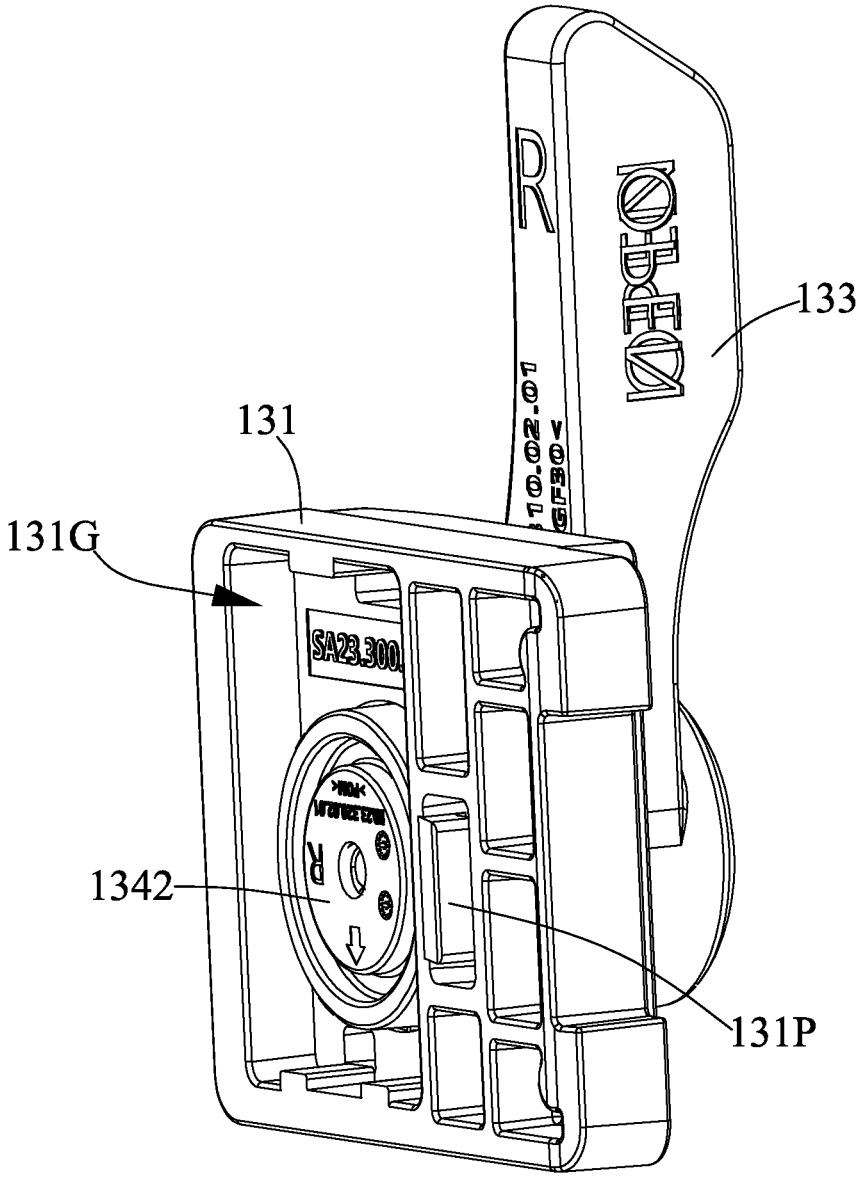
FIG. 4A illustrates a schematic view of the pressing piece 1342 inside the installation groove 131G.
Figure 4B:
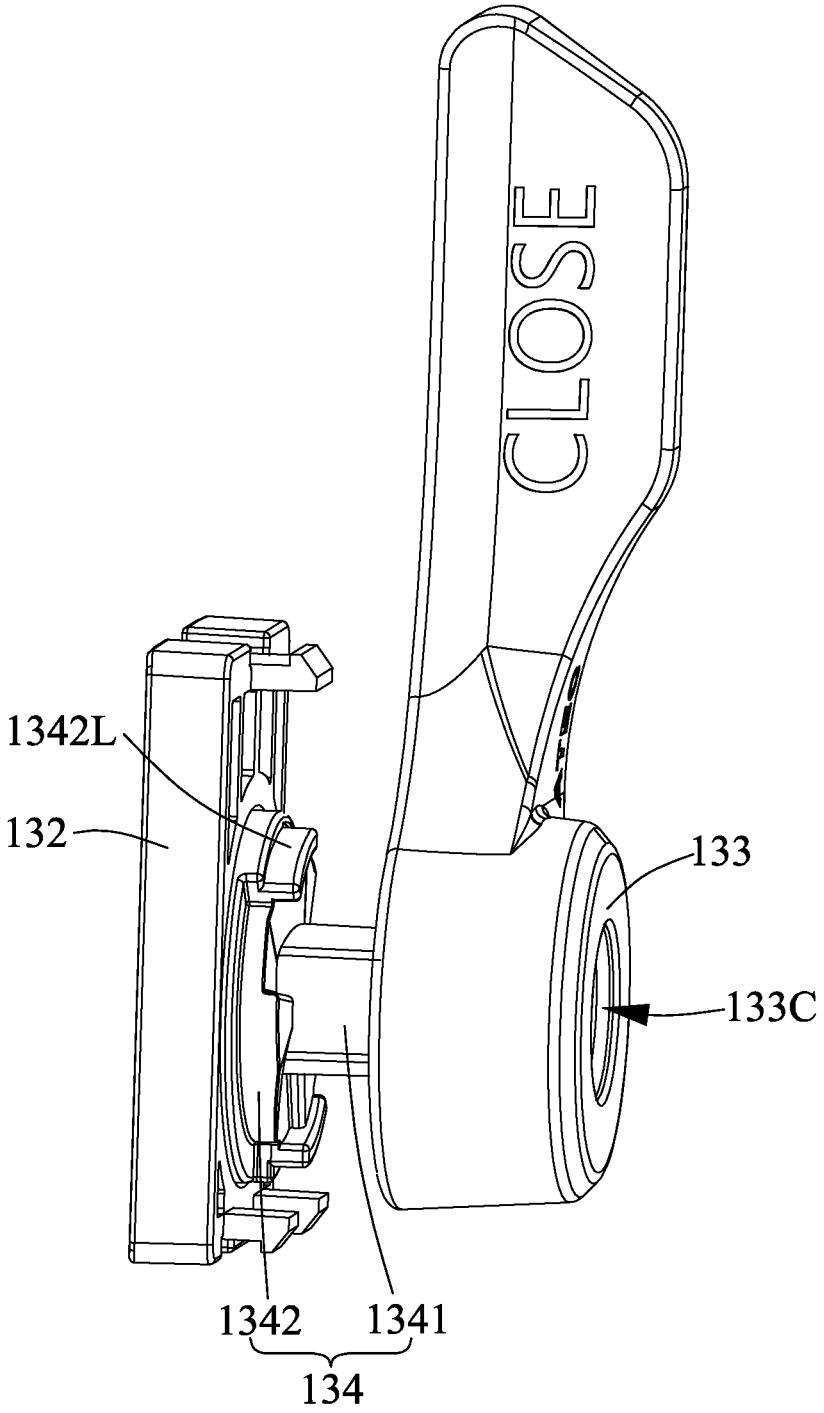
FIG. 4B illustrates a schematic view of the positional relationship between the clamping element 132, operating component 133, and transmission element 134.
Figure 4C:
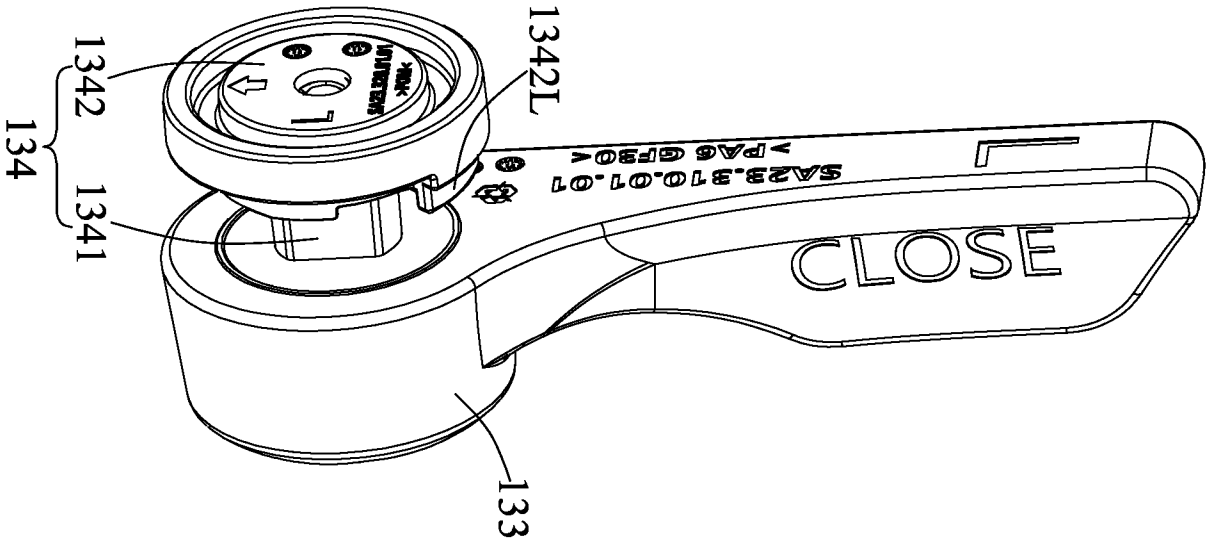
FIG. 4C illustrates a schematic view of the transmission element 134 connected to the operating component 133.
Figure 4D:
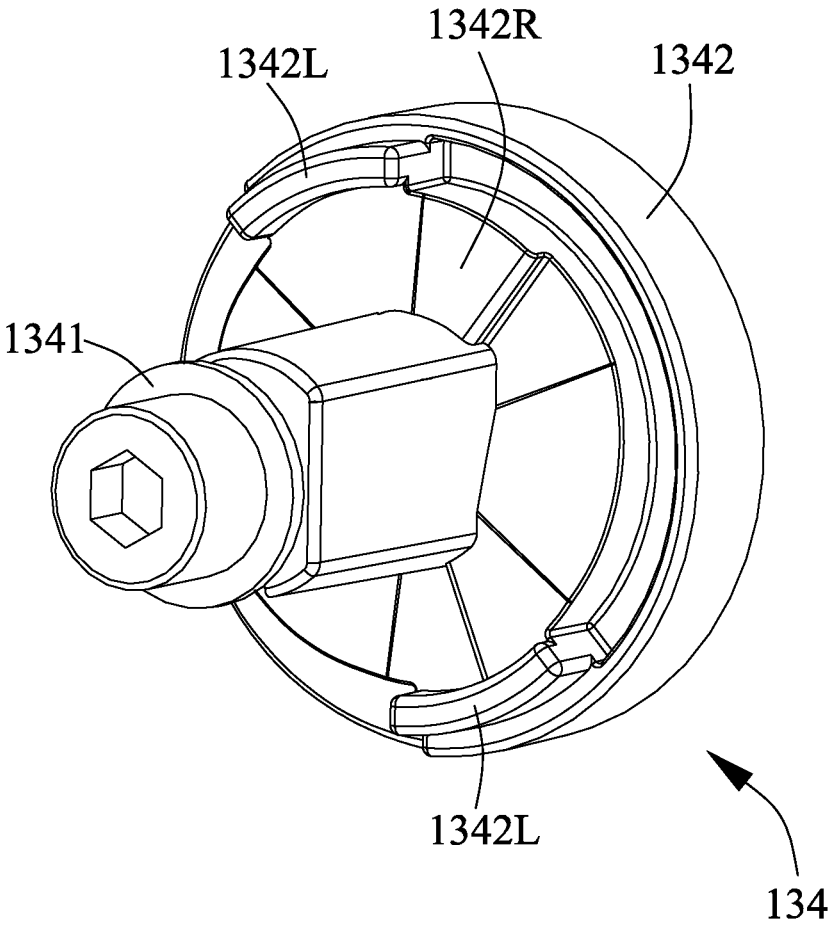
FIG. 4D illustrates a schematic view of the transmission element 134.

Refer to FIGS. 4A to 4D, where FIG. 4A illustrates a schematic view of the pressing piece 1342 inside the installation groove 131G, FIG. 4B illustrates a schematic view of the positional relationship between the clamping element 132, operating component 133, and transmission element 134, FIG. 4C illustrates a schematic view of the transmission element 134 connected to the operating component 133, and FIG. 4D illustrates a schematic view of the transmission element 134. In this embodiment, the transmission element 134 connects the clamping element 132 with the operating component 133 and includes an installation shaft 1341 and a pressing piece 1342. One end of the installation shaft 1341 is installed in the central hole 133C, while the pressing piece 1342 is installed at the other end of the installation shaft 1341 and located inside the installation groove 131G. The installation shaft 1341 is designed with a foolproof structure featuring arcuate surfaces on its top and bottom sides and flat surfaces on its left and right sides (refer to FIG. 4D). This structure helps prevent errors due to human operation, thereby enhancing the product's reliability, stability, and safety.

Furthermore, the pressing piece 1342 presses against the clamping element 132 and includes a first ratchet piece 1342R and two first limit pieces 1342L. The first ratchet piece 1342R is near one side of the installation groove 131G, and the two first limit pieces 1342L are respectively located on both sides of the first ratchet piece 1342R, in parallel symmetry.

Additionally, refer again to FIG. 3C. The installation groove 131G includes a second ratchet piece 131R, a through-hole 131H, and two second limit pieces 1312. The second ratchet piece 131R is positioned at the bottom of the installation groove 131G. The through-hole 131H is located at the center of the second ratchet piece 131R, with its center aligning with the center of the central hole 133C, and the installation shaft 1341 passes through the through-hole 131H. In other words, the second ratchet piece 131R is positioned between the pressing piece 1342 and the operating component 133.

Moreover, the second ratchet piece 131R is coupled with the first ratchet piece 1342R. Specifically, when the rotating handle is in the open position, the highest point of the first ratchet piece 1342R touches the lowest point of the second ratchet piece 131R, and the highest point of the second ratchet piece 131R also touches the lowest point of the first ratchet piece 1342R, forming a coupled state between the two ratchet pieces. In this state, the position of armrest 8 can be adjusted within a certain range, which is the lateral length of the crossbar slot 81G.

Furthermore, the two second limit pieces 1312 of the installation groove 131G are also respectively located on both sides of the second ratchet piece 131R, in parallel symmetry. And when the second ratchet piece 131R is coupled with the first ratchet piece 1342R, the two first limit pieces 1342L and the two second limit pieces 1312 are in an interleaved arrangement. Thus, the first limit pieces 1342L and the second limit pieces 1312 limit the range of rotation of the rotating handle (operating component 133).

In this embodiment, the operating component 133 is designed to drive the transmission element 134, causing the transmission element 134 to move the clamping element 132 towards and press against the crossbar 81. Specifically, when the rotating handle is turned in one direction (closed position), the installation shaft 1341 drives the first ratchet piece 1342R and the second ratchet piece 131R to move relative to each other, with the highest point of the first ratchet piece 1342R touching the highest point of the second ratchet piece 131R, causing the pressing piece 1342 to move the clamping element 132 towards the crossbar 81. Consequently, the clamping element 132 fixes the crossbar 81 in place, creating a sufficient frictional force between the surface of the clamping element 132 and the surface of the crossbar 81, thus preventing the crossbar 81 from being easily moved by external forces. Conversely, when the rotating handle is turned back to its original position, the surface of the clamping element 132 separates from the surface of the crossbar 81, allowing the user to adjust the position of the armrest 8's crossbar 81 within a certain range.

Figure 5A:
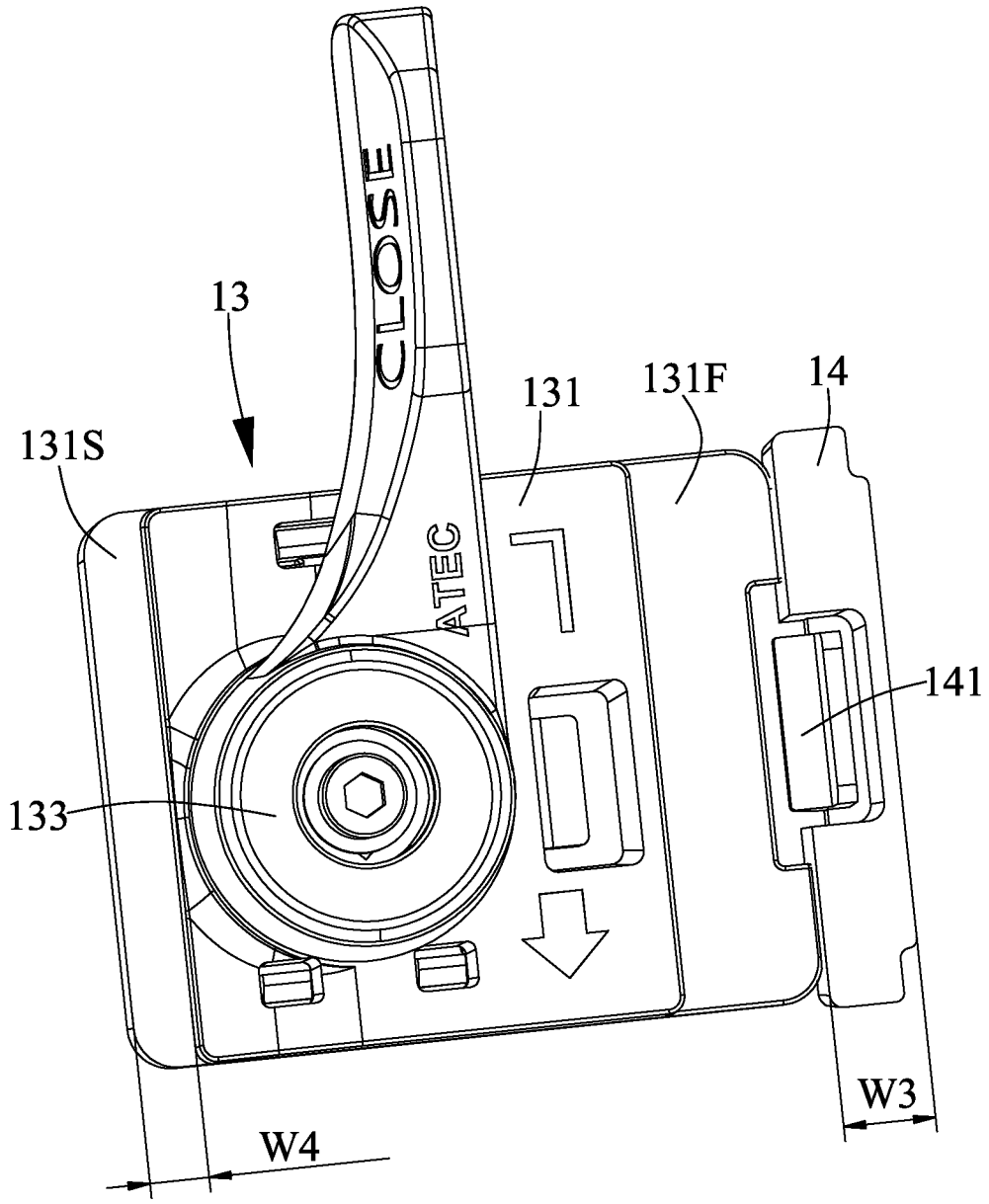
FIGS. 5A and 5B illustrate schematic views of the clamping device 13 and anti-slip plate 14 from different angles.
Figure 5B:
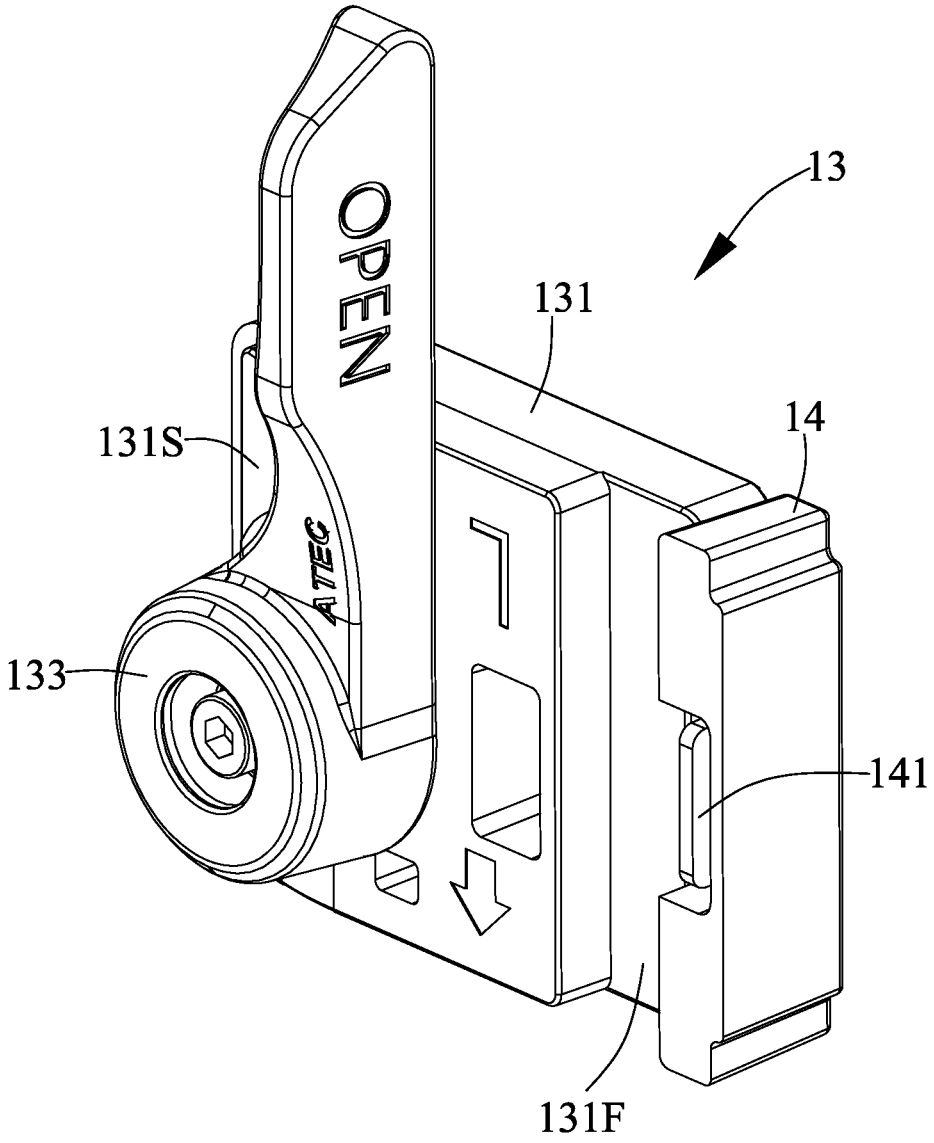
Figure 5C:
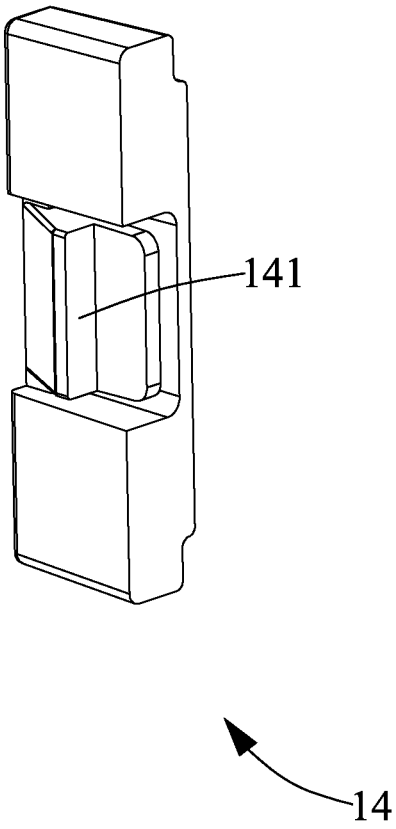
FIG. 5C illustrates a schematic view of the anti-slip plate 14.
Figure 5D:
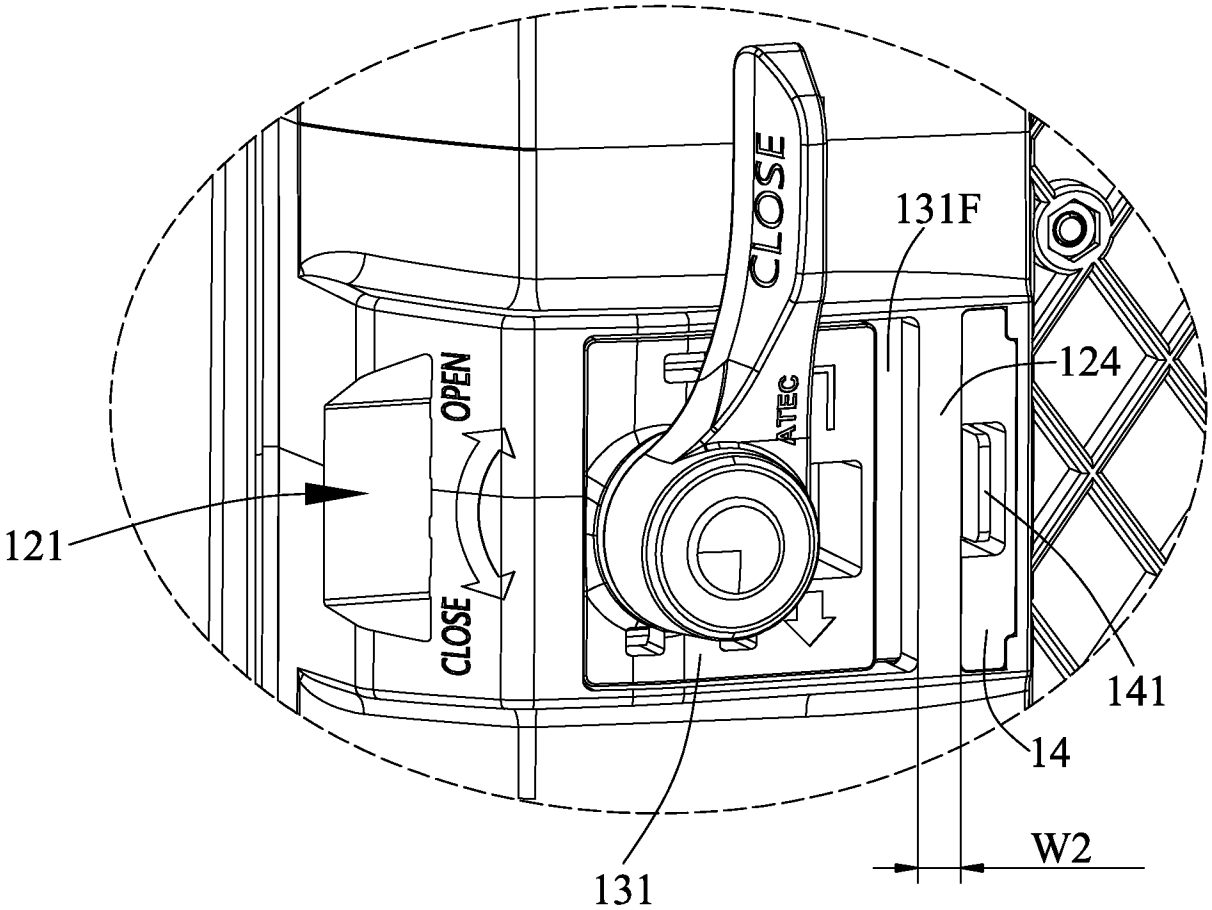
FIG. 5D illustrates an enlarged view of the section marked X in FIG. 1A.

Refer to FIGS. 5A and 5B, which illustrate schematic views of the clamping device 13 and anti-slip plate 14 from different angles, FIG. 5C, which illustrates a schematic view of the anti-slip plate 14, and FIG. 5D, which illustrates an enlarged view of the section marked X in FIG. 1A. The chair seat 10 also includes two anti-slip plates 14, each installed in an embedding hole 123. In this embodiment, the anti-slip plate 14 has an anti-pull structure 141, which engages with the support beam 124 of the base 12. Therefore, when the anti-slip plate 14 is inserted into the embedding hole 123, the anti-pull structure 141 prevents the anti-slip plate 14 from falling out of the embedding hole 123. Additionally, when external force is applied to the anti-pull structure 141, it disengages from the support beam 124, allowing the anti-slip plate 14 to be removed from the embedding hole 123.

Furthermore, the mounting base 131 has a first engaging edge 131F and a second engaging edge 131S on its opposite sides. The mounting base 131 is supported on the base 12 through the first engaging edge 131F and the second engaging edge 131S, with the first engaging edge 131F abutting against the anti-slip plate 14. Specifically, the width W1 of the first engaging edge 131F (refer to FIG. 3A) is greater than the width W2 of the support beam 124 (refer to FIG. 5D), while the width of the second engaging edge 131S engaging with the base 12 is less than the width W3 of the anti-slip plate 14 (refer to FIG. 5A). In this embodiment, the width of the second engaging edge 131S engaging with the base 12 is the overall width W4 of the second engaging edge 131S (refer to FIG. 5A). Therefore, before the anti-slip plate 14 is inserted into the embedding hole 123, the mounting base 131 can be installed inside the mounting hole 122, with the first engaging edge 131F supported on the lower surface of the support beam 124. Subsequently, the anti-slip plate 14 is inserted into the embedding hole 123, and the side of the first engaging edge 131F abuts against the anti-slip plate 14.

Additionally, to remove the crossbar 81 of the armrest 8 from the base 12, the anti-slip plate 14 must first be removed from the embedding hole 123. Then, by moving the mounting base 131 of the clamping device 13 towards the embedding hole 123, the clamping device 13 can be separated from the base 12. As the crossbar slot 81G of the crossbar 81 is no longer obstructed by the anti-pull piece 131P of the clamping device 13, the crossbar 81 of the armrest 8 can be pulled out from the armrest slot 121. Thus, the chair seat 10 of this embodiment can be easily assembled and disassembled, allowing the two armrests 8 to be removed. This facilitates reducing the size of the external packaging box for the chair seat 10, significantly lowering the cost of transporting the product.

Figure 6A:
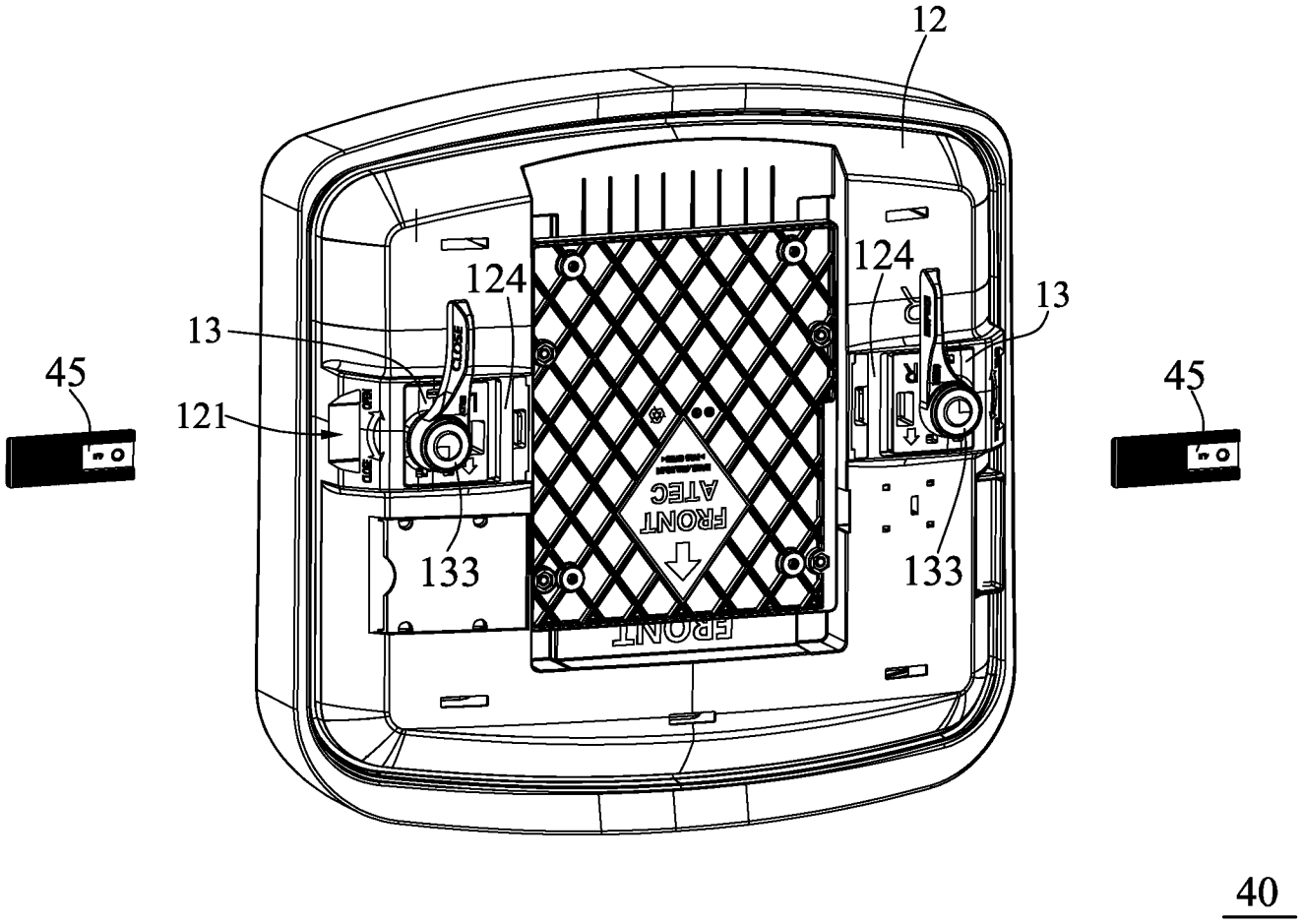
FIG. 6A illustrates a schematic view of another embodiment of the chair seat 40.
Figure 6B:
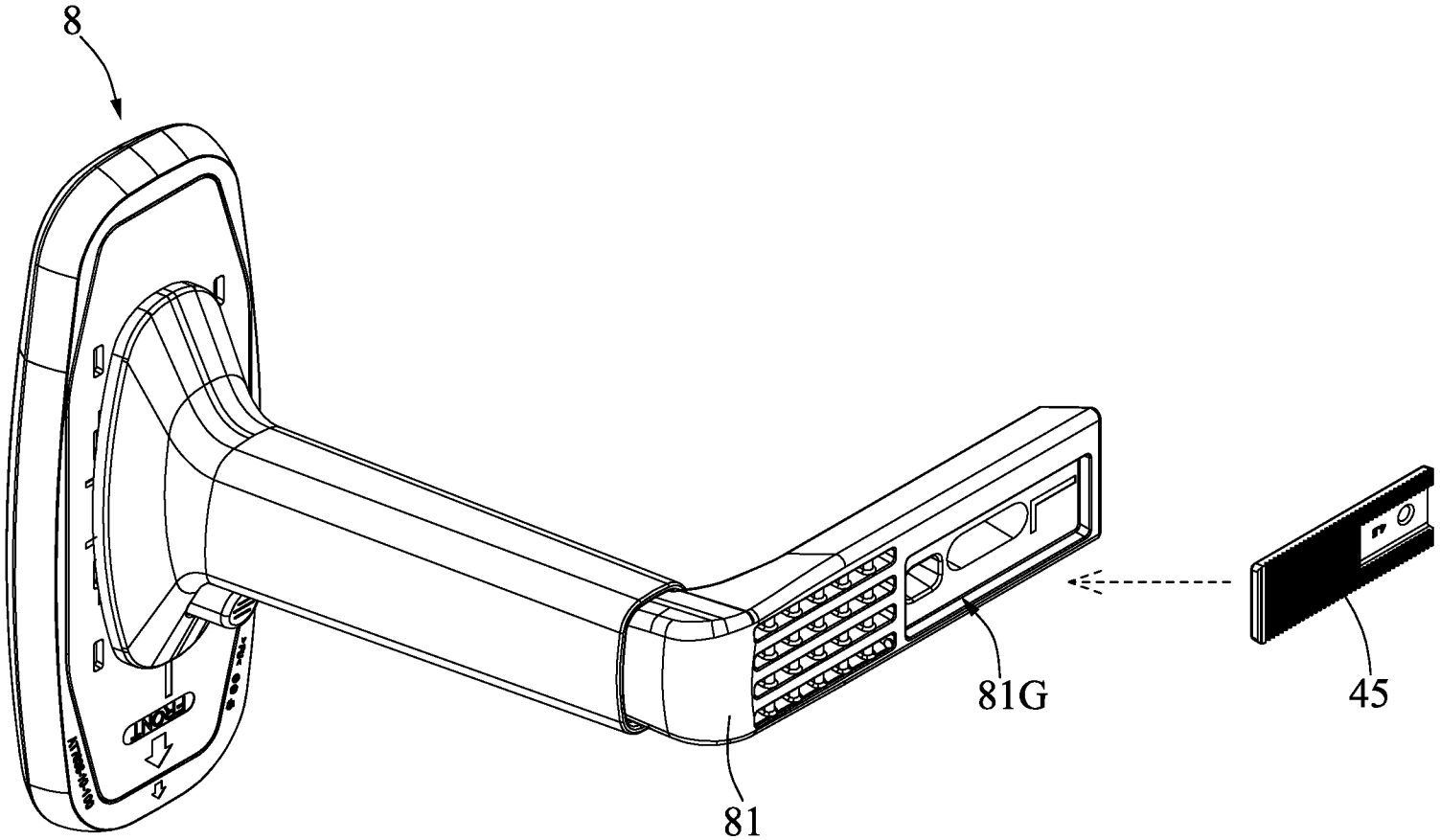
FIGS. 6B and 6C illustrate schematic views of the first toothed structure 45 embedded in the crossbar slot 81G.
Figure 6C:
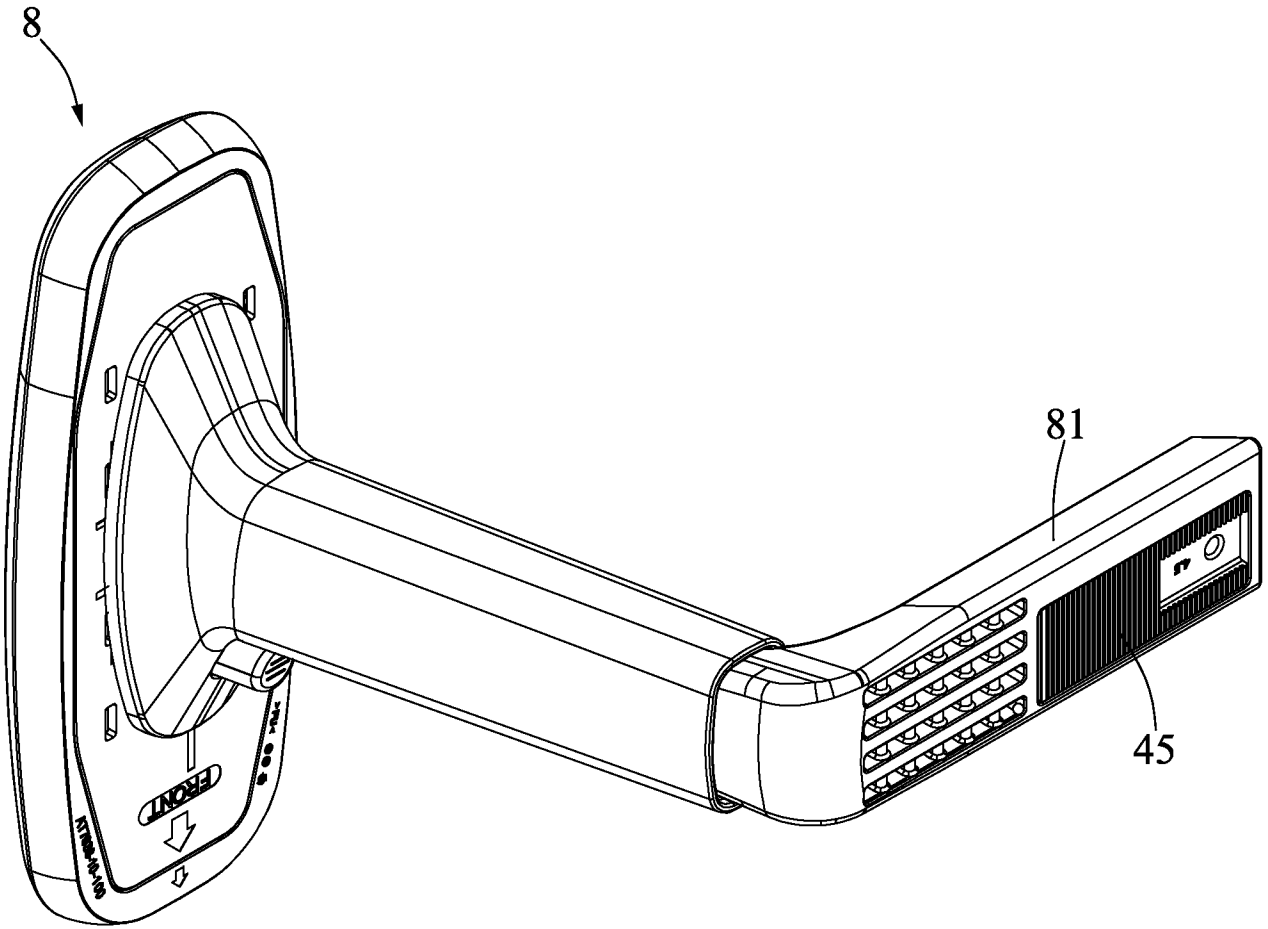
Figure 6D:
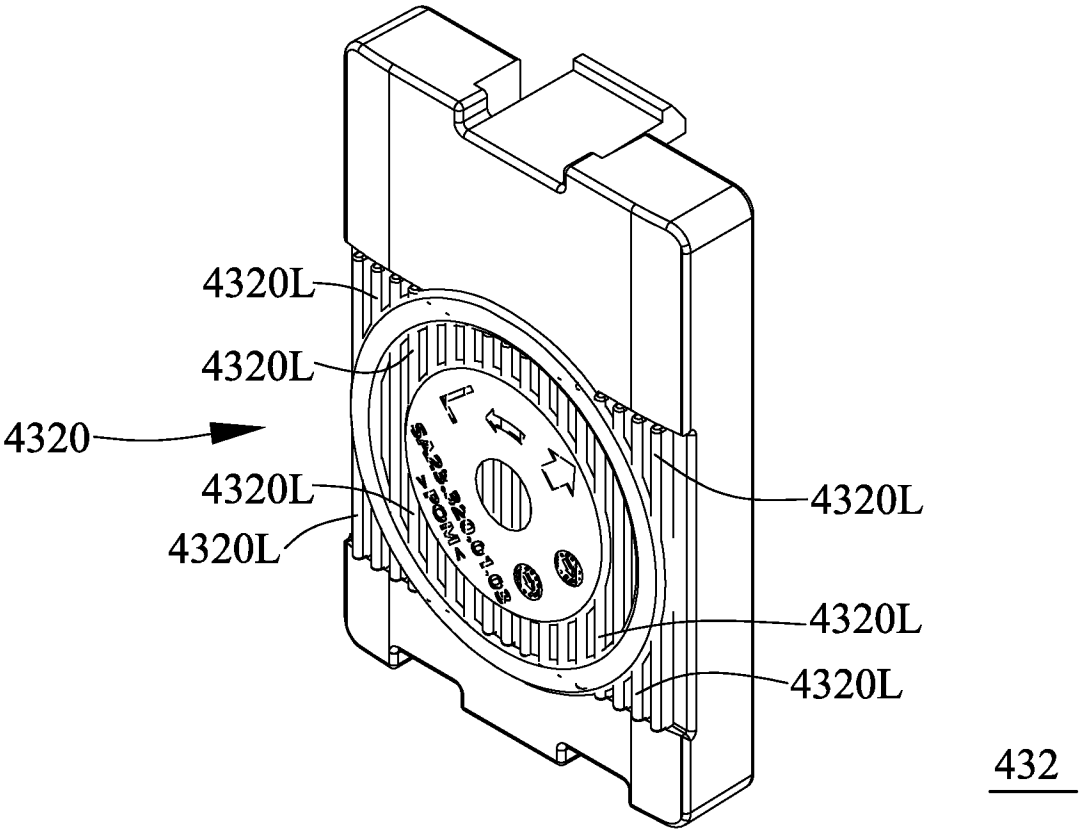
FIG. 6D illustrates a schematic view of the clamping element 432.
Figure 6E:
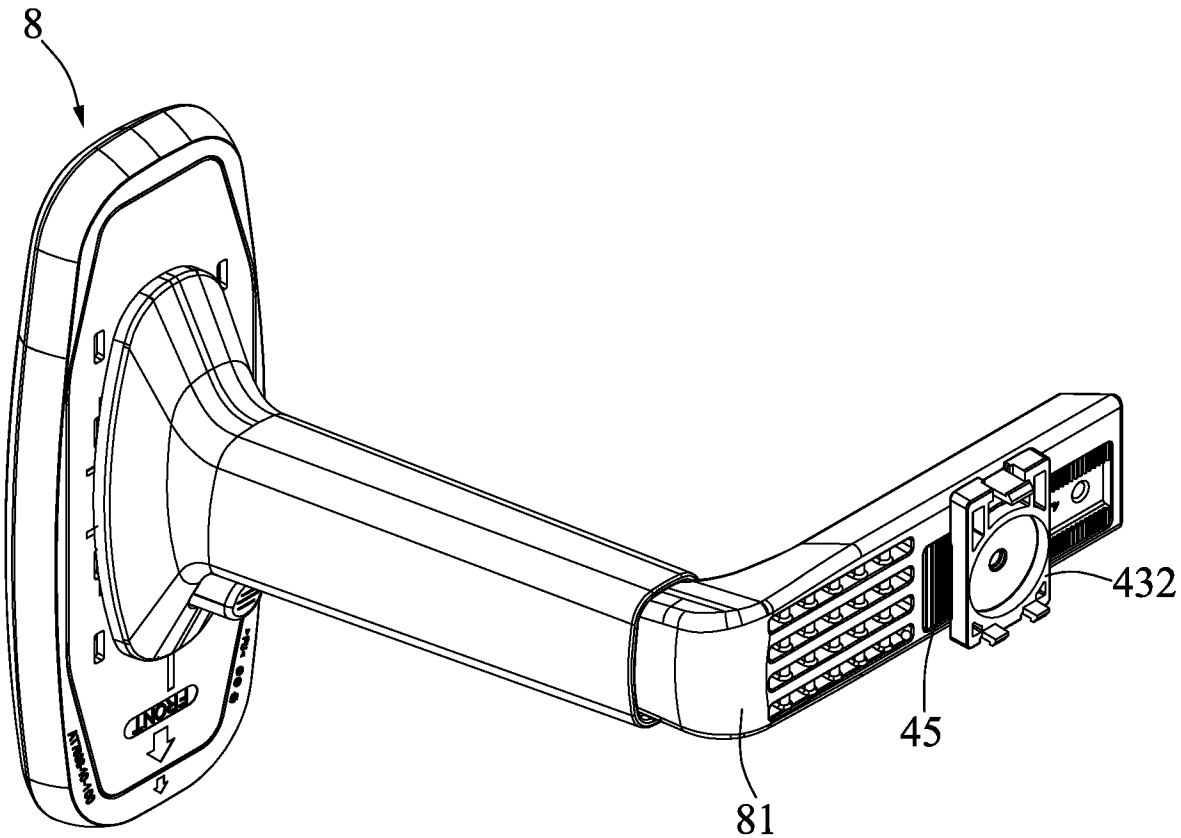
FIG. 6E illustrates a schematic view of the clamping element 432 abutting against the first toothed structure 45.
Figure 7:
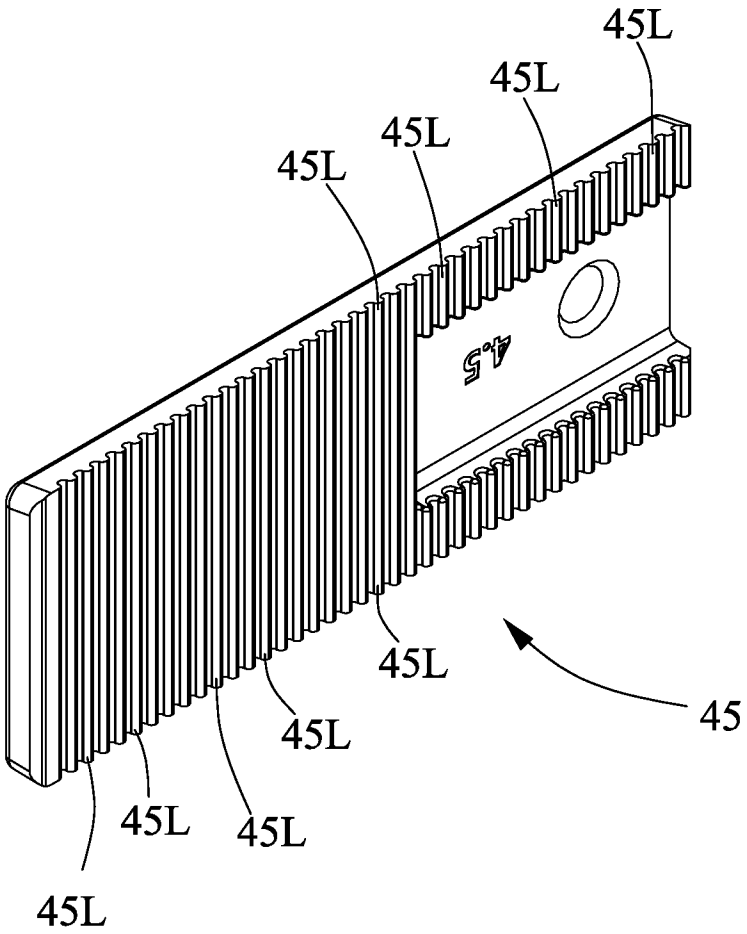
FIG. 7 illustrates a schematic view of the first toothed structure 45.

Refer to FIGS. 6A to 6E, where FIG. 6A illustrates a schematic view of another embodiment of the chair seat 40, FIGS. 6B and 6C illustrate schematic views of the first toothed structure 45 embedded in the crossbar slot 81G, FIG. 6D illustrates a schematic view of the clamping element 432, and FIG. 6E illustrates a schematic view of the clamping element 432 abutting against the first toothed structure 45. The difference between chair seat 40 and chair seat 10 is that chair seat 40 also includes two first toothed structures 45. Each first toothed structure 45 comprises multiple closely arranged first limit bars 45L (refer to FIG. 7), and each first toothed structure 45 is separately embedded in the crossbar slot 81G.

Additionally, the clamping element 432 of chair seat 40 is equipped with a second toothed structure 4320, facing the first toothed structure 45. The second toothed structure 4320 includes multiple closely arranged second limit bars 4320L (refer to FIG. 6D), each parallel to the first limit bars 45L. In this embodiment, when the transmission element 134 moves the clamping element 432 towards and presses against the crossbar 81, the second toothed structure 4320 closely engages with the first toothed structure 45. Since the multiple second limit bars 4320L are parallel to the multiple first limit bars 45L, it is easier to determine the position of the armrest 8 when they engage. This allows the user to easily adjust the distance between the left and right armrests 8.

Figure 8A:
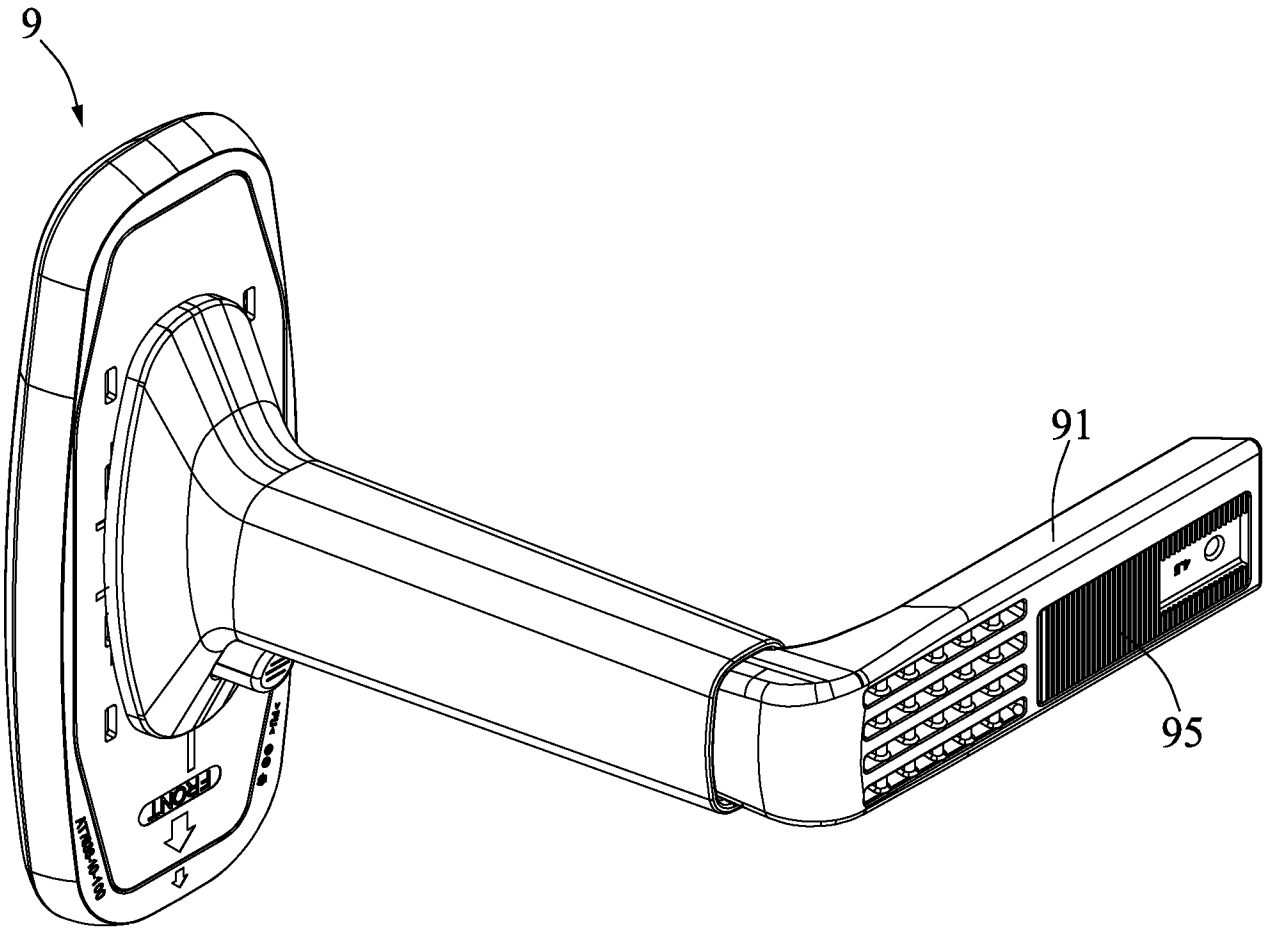
FIG. 8A illustrates a schematic view of the armrest 9.
Figure 8B:
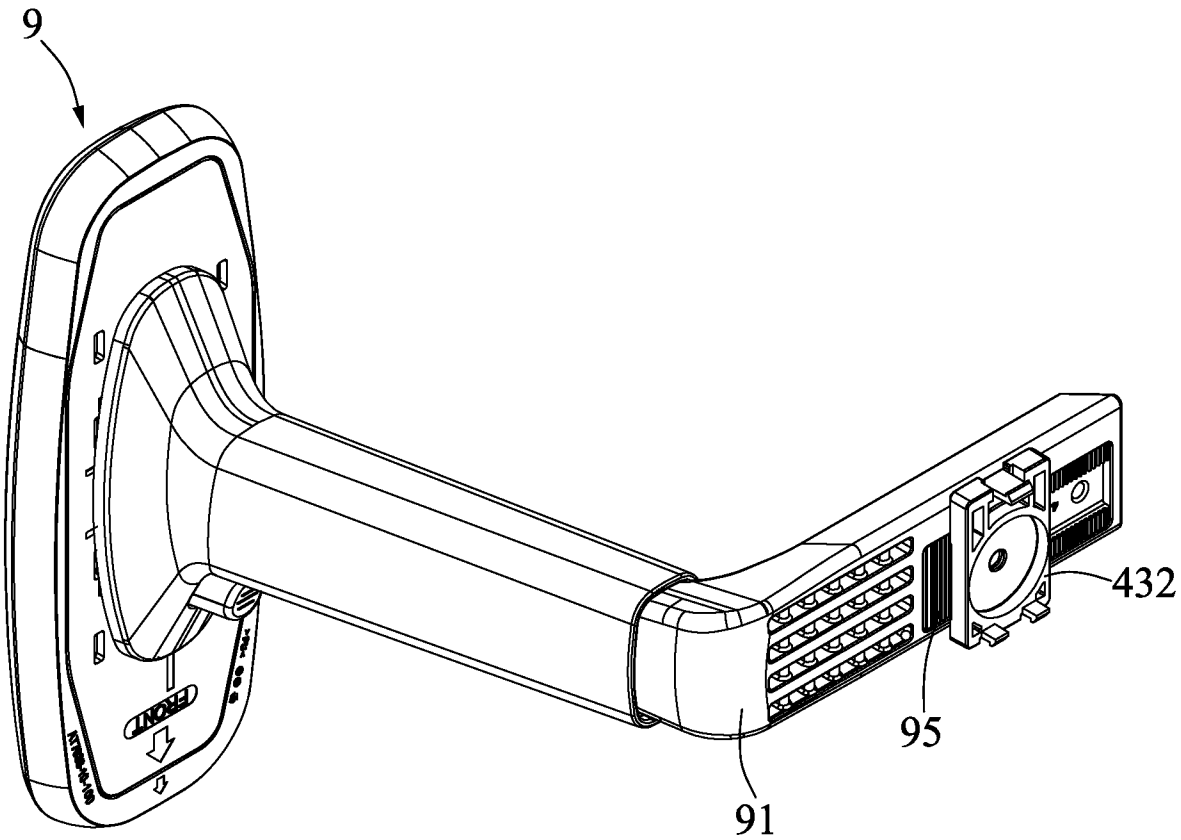
FIG. 8B illustrates a schematic view of the clamping element 432 abutting against the first toothed structure 95.

In the aforementioned embodiment, the first toothed structure 45 of chair seat 40 is embedded in the crossbar slot 81G of the crossbar 81. However, in other embodiments, the crossbar 81 and the first toothed structure 45 can be an integral structure, meaning that this embodiment does not have the technical feature of the crossbar slot 81G. For example, refer to FIGS. 8A and 8B, where a first toothed structure 95 is located on the crossbar 91 of armrest 9. In other words, the crossbar 91 and the first toothed structure 95 are an integral structure. Moreover, the technical features of the first toothed structure 95 are equivalent to those of the first toothed structure 45. When the clamping element 432 moves towards and presses against the crossbar 91, the second toothed structure 4320 closely engages with the first toothed structure 95. Thus, the user can also easily adjust the distance between the left and right armrests 9.

In summary, compared to traditional adjustable armrest office chairs, the chair seats 10 and 40 of these embodiments facilitate the assembly of the armrests 8 and the clamping devices 13 without the need for additional parts (such as screws) to secure the mounting base 131. This makes it easier for users to assemble the armrests 8 on both sides and also reduces production costs. Additionally, it allows for easy adjustment of the distance between the left and right armrests 8.

Although the invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A chair seat adapted for integration with two armrests, each armrest comprising a crossbar with a first toothed structure, the chair seat comprising:

a base including at least one armrest slot and two mounting holes, the armrest slot accommodating the crossbar, and the mounting holes communicating with the armrest slot; and two clamping devices, each installed in the two mounting holes, each clamping device comprising:

a mounting base installed and fixed in the mounting hole, with a first side of the mounting base having an installation groove;

a clamping element installed in the installation groove, the clamping element having a second toothed structure facing the first toothed structure;

an operating component positioned on a second side of the mounting base opposite the first side; and a transmission element connecting the clamping element and the operating component;

wherein the operating component is adapted to drive the transmission element, causing the clamping element to move towards and clamp the crossbar, enabling the second toothed structure to engage closely with the first toothed structure;

wherein the first toothed structure comprises a plurality of closely arranged first limit bars, the second toothed structure comprises a plurality of closely arranged second limit bars, and each of the second limit bars is parallel to each of the first limit bars.

2. The chair seat according to claim 1, wherein the operating component is a rotating handle with a central hole, and the transmission element comprises an installation shaft and a pressing piece, one end of the installation shaft being installed in the central hole, and the pressing piece being installed at the other end of the installation shaft and located within the installation groove, the pressing piece having a first ratchet piece on one side close to the installation groove, and pressing against the clamping element;

wherein a second ratchet piece is located at the bottom of the installation groove, engaged with the first ratchet piece;

wherein when the rotating handle is turned in one direction, the installation shaft causes the first ratchet piece and the second ratchet piece to move relative to each other, causing the pressing piece to move the clamping element towards and clamp the crossbar.

3. The chair seat according to claim 2, wherein the pressing piece further comprises two first limit pieces, each of the first limit pieces being located on either side of the first ratchet piece, and in parallel symmetry; the installation groove further comprising two second limit pieces, each of the second limit pieces being located on either side of the second ratchet piece, and in parallel symmetry.

4. The chair seat according to claim 1, further comprising two anti-slip plates, each mounting hole of the base having a neighboring embedding hole for the anti-slip plate, and the mounting base having a first engaging edge and a second engaging edge on its opposing sides; wherein, the mounting base is supported on the base by the first engaging edge and the second engaging edge, with the first engaging edge abutting against the anti-slip plate.

5. The chair seat according to claim 4, wherein the embedding hole and the mounting hole are separated by a support beam, and the first engaging edge is supported on the support beam, with the width of the first engaging edge being greater than the width of the support beam, and the width of the second engaging edge engaging with the base being less than the width of the anti-slip plate.

6. The chair seat according to claim 5, wherein the anti-slip plate has an anti-pull structure, which engages with the support beam.

7. A chair seat adapted for integration with two armrests, each armrest comprising a crossbar with a crossbar slot, the chair seat comprising:

two first toothed structures, each embedded in the crossbar slot;

a base including at least one armrest slot and two mounting holes, the armrest slot accommodating the crossbar, and the mounting holes communicating with the armrest slot; and two clamping devices, each installed in the two mounting holes, each clamping device comprising:

a mounting base installed and fixed in the mounting hole, with a first side of the mounting base having an installation groove;

a clamping element installed in the installation groove, the clamping element having a second toothed structure facing the first toothed structure;

an operating component positioned on a second side of the mounting base opposite the first side; and a transmission element connecting the clamping element and the operating component;

wherein the operating component is adapted to drive the transmission element, causing the clamping element to move towards and clamp the crossbar, enabling the second toothed structure to engage closely with the first toothed structure;

wherein the first toothed structure comprises a plurality of closely arranged first limit bars, the second toothed structure comprises a plurality of closely arranged second limit bars, and each of the second limit bars is parallel to each of the first limit bars.

8. The chair seat according to claim 7, wherein the operating component is a rotating handle with a central hole, and the transmission element comprises an installation shaft and a pressing piece, one end of the installation shaft being installed in the central hole, and the pressing piece being installed at the other end of the installation shaft and located within the installation groove, the pressing piece having a first ratchet piece on one side close to the installation groove, and pressing against the clamping element;

wherein a second ratchet piece is located at the bottom of the installation groove, engaged with the first ratchet piece;

wherein when the rotating handle is turned in one direction, the installation shaft causes the first ratchet piece and the second ratchet piece to move relative to each other, causing the pressing piece to move the clamping element towards and clamp the crossbar.

9. The chair seat according to claim 8, wherein the pressing piece further comprises two first limit pieces, each of the first limit pieces being located on either side of the first ratchet piece, and in parallel symmetry; the installation groove further comprising two second limit pieces, each of the second limit pieces being located on either side of the second ratchet piece, and in parallel symmetry.

10. The chair seat according to claim 7, further comprising two anti-slip plates, each mounting hole of the base having a neighboring embedding hole for the anti-slip plate, and the mounting base having a first engaging edge and a second engaging edge on its opposing sides; wherein, the mounting base is supported on the base by the first engaging edge and the second engaging edge, with the first engaging edge abutting against the anti-slip plate.

11. The chair seat according to claim 10, wherein the embedding hole and the mounting hole are separated by a support beam, and the first engaging edge is supported on the support beam, with the width of the first engaging edge being greater than the width of the support beam, and the width of the second engaging edge engaging with the base being less than the width of the anti-slip plate.

12. The chair seat according to claim 11, wherein the anti-slip plate has an anti-pull structure, which engages with the support beam.

* * * * *